US009494361B2

(12) United States Patent
Hatomura et al.

(10) Patent No.: US 9,494,361 B2
(45) Date of Patent: Nov. 15, 2016

(54) AIR-CONDITIONING APPARATUS WITH IMPROVED DEFROST OPERATION MODE

(75) Inventors: Takeshi Hatomura, Tokyo (JP); Koji Yamashita, Tokyo (JP); Hiroyuki Morimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 197 days.

(21) Appl. No.: 14/118,344

(22) PCT Filed: Mar. 22, 2012

(86) PCT No.: PCT/JP2012/001980

§ 371 (c)(1),
(2), (4) Date: Nov. 18, 2013

(87) PCT Pub. No.: WO2013/008365

PCT Pub. Date: Jan. 17, 2013

(65) Prior Publication Data

US 2014/0182320 A1 Jul. 3, 2014

(30) Foreign Application Priority Data

Jul. 14, 2011 (WO) ..... PCT/JP2011/004030

(51) Int. Cl.

*F25D 21/06* (2006.01)
*F25B 13/00* (2006.01)
*F25B 25/00* (2006.01)

(52) U.S. Cl.

CPC ..... *F25D 21/06* (2013.01); *F25B 13/00* (2013.01); *F25B 25/005* (2013.01); (Continued)

(58) Field of Classification Search

CPC ..... F25B 25/005; F25B 7/00; F25B 13/00; F25B 47/02; F25B 47/022; F25B 47/025; F24F 11/02; F24F 1/08; F24F 1/23–1/34

See application file for complete search history.

(56) References Cited

U.S. PATENT DOCUMENTS 6,012,294 A * 1/2000 Utsumi ..... 62/81
8,943,847 B2 * 2/2015 Yamashita et al. ..... 62/159

(Continued)

FOREIGN PATENT DOCUMENTS

EP 2495511 A1 9/2012
JP 61-58468 U 4/1986

(Continued)

OTHER PUBLICATIONS

Machine Translation for Takenaka et al. WO2011030429.*

(Continued)

*Primary Examiner* — Ryan J Walters
*Assistant Examiner* — Antonio R Febles
(74) *Attorney, Agent, or Firm* — Posz Law Group, PLC

(57) ABSTRACT

An air-conditioning apparatus includes: an outdoor unit including a compressor, a first refrigerant flow path switching device, and a heat-source-side heat exchanger; a heat medium relay unit including an intermediate heat exchanger, an expansion device, a second refrigerant flow path switching device, and a pump; and at least one indoor unit including a use-side heat exchanger. A refrigerant pipe connects the compressor, the first refrigerant flow path switching device, the expansion device, the second refrigerant flow path switching device, and the intermediate heat exchanger, thereby making up a refrigeration cycle. A heat medium pipe connects the intermediate heat exchanger and the use-side heat exchanger, thereby making up a heat medium circulation circuit in which a heat medium different from the refrigerant circulates. The first refrigerant flow path switching device is switched to execute a defrost operation mode.

6 Claims, 9 Drawing Sheets

(52) U.S. Cl.
CPC ..... *F25B 2313/0231* (2013.01); *F25B 2313/0272* (2013.01); *F25B 2313/02322* (2013.01); *F25B 2313/02732* (2013.01); *F25B 2313/02741* (2013.01)

(56) References Cited

U.S. PATENT DOCUMENTS

| | | | | |
|---|---|---|---|---|
| 2009/0277207 | A1* | 11/2009 | Park | 62/324.6 |
| 2011/0185756 | A1* | 8/2011 | Yamashita et al. | 62/171 |
| 2011/0225998 | A1* | 9/2011 | Yamashita et al. | 62/126 |

FOREIGN PATENT DOCUMENTS

| | | | | |
|---|---|---|---|---|
| JP | 2005-274134 | A | 10/2005 | |
| JP | 2008-224088 | A | 9/2008 | |
| JP | 2011-127775 | A | 6/2011 | |
| WO | 2010/049998 | A1 | 5/2010 | |
| WO | 2010/050002 | A1 | 5/2010 | |
| WO | WO 2010050002 | A1 * | 5/2010 | F24F 3/06 |
| WO | 2011/030429 | A1 | 3/2011 | |
| WO | 2011/052038 | A1 | 5/2011 | |

OTHER PUBLICATIONS

Machine Translation for Yamashita WO2011050002.*
Machine Translation for Takenaka et al. WO2011/030429.*
Machine Translation for Yamashita WO2010/050002.*
International Search Report of the International Searching Authority mailed Jun. 26, 2012 for the corresponding international application No. PCT/JP2012/001980 (and English translation).
Office Action mailed Dec. 2, 2014 issued in corresponding JP patent application No. 2013-523772 (and English translation).
Office Action dated Feb. 27, 2015 issued in corresponding CN patent application No. 201280031532.0 (and English translation).
Extended European Search Report issued on May 21, 2015 for corresponding EP Application No. 12811031.9.

* cited by examiner

AIR-CONDITIONING APPARATUS WITH IMPROVED DEFROST OPERATION MODE

CROSS REFERENCE TO RELATED APPLICATION

This application is a U.S. national stage application of International Application No. PCT/JP2012/001980 filed on Mar. 22, 2012.

TECHNICAL FIELD

The present invention relates to an air-conditioning apparatus to be applied to a multi-air-conditioning apparatus for buildings, for example.

BACKGROUND ART

Some air-conditioning apparatuses, such as multi-air-conditioning apparatuses for buildings, have a heat source device (outdoor unit) disposed outside the building, and an indoor unit disposed within a room in the building. A refrigerant circulating within a refrigerant circuit of the air-conditioning apparatus transfers heat to (absorbs heat from) air supplied to a heat exchanger of the indoor unit to heat or cool this air. The heated or cooled air is transported into a space to be air-conditioned to perform heating or cooling.

Such an air-conditioning apparatus is constituted by multiple indoor units since buildings generally have multiple indoor spaces. Also, in the case where the scale of a building is great, a refrigerant pipe which connects an outdoor unit and indoor units may have a length of 100 m. The longer the length of the pipe which connects the outdoor unit and the indoor units, the more the refrigerant fills the refrigerant circuit.

The indoor units of such a multi-air-conditioning apparatus for buildings are generally disposed in indoor spaces where people are present (for example, office spaces, living rooms, shops, etc.). In the case where a refrigerant has leaked from an indoor unit disposed in an indoor space for one reason or another, there may occur a problem in terms of the influence on the human body and safety because some refrigerant might be flammable or toxic depending on its type. Also, even if this refrigerant is a refrigerant which is not harmful to the human body, it may be anticipated that the oxygen concentration in the indoor space will decrease due to refrigerant leakage, which can affect the human body.

To address this problem, there is a method in which with the use of the secondary loop method, a refrigerant is circulated in the primary side loop and a harmless heat medium such as water or brine is circulated in the secondary side loop, so that the heating energy or cooling energy of the refrigerant is transmitted to the heat medium (for example, see Patent Literature 1). In the technology disclosed in Patent Literature 1, the heating energy or cooling energy generated in the primary side loop is transmitted to the secondary side loop via an intermediate heat exchanger such as a plate heat exchanger or a double pipe, and the heating energy or cooling energy is supplied to an indoor unit through the secondary side loop. Also, in the technology disclosed in Patent Literature 1, a pipe corresponding to the secondary side loop where this harmless heat medium circulates is situated near a space where a person is present, and accordingly, the effect on the human body due to refrigerant leakage can be suppressed.

On the other hand, when an outdoor unit heat exchanger which executes a heating operation serves as an evaporator, frost is apt to be formed on fins of the outdoor unit heat exchanger where the temperature of the outside air is low. The formation of frost disturbs heat exchange between the outdoor air supplied by a fan or the like and the refrigerant flowing through a tube of the outdoor unit heat exchanger, resulting in a reduction in heat exchange efficiency. There is known a technology in which to remove the frost of the outdoor unit heat exchanger, a defrost operation is performed to supply a high-temperature refrigerant to the outdoor unit heat exchanger.

When this defrost operation is applied to the technology disclosed in Patent Literature 1, the refrigerant flowing into the intermediate heat exchanger via the outdoor unit heat exchanger and an expansion device, and flowing out from the intermediate heat exchanger is sucked into the compressor again. Here, the refrigerant flowing out from the expansion device has a low temperature due to operating as a condenser of the outdoor unit heat exchanger, and the pressure of the refrigerant is reduced due to the operation of the expansion device.

Thus, the refrigerant flowing out from the expansion device may receive heat from the heat medium in the secondary side loop and evaporate in the intermediate heat exchanger, thereby freezing this heat medium. Therefore, there has been proposed an air-conditioning apparatus including a bypass pipe which bypasses an intermediate heat exchanger (for example, see Patent Literature 2). The technology disclosed in Patent Literature 2 suppresses freezing of the heat medium in the secondary side loop by making the flow resistance of the bypass pipe smaller than that of the intermediate heat exchanger and reducing the amount of the refrigerant flowing into the intermediate heat exchanger.

CITATION LIST

Patent Literature

Patent Literature 1: International Publication Pamphlet No. WO 10/049,998 (for example, see page 3 and FIG. 1)

Patent Literature 2: Japanese Unexamined Patent Application Publication No. 2005-274134 (for example, see page 2 and FIG. 3)

SUMMARY OF INVENTION

Technical Problem

The technology disclosed in Patent Literature 1 does not disclose suppression of freezing of the heat medium during the defrost operation. Carrying out a defrost operation using while applying the technology disclosed in Patent Literature 2 to the technology disclosed in Patent Literature 1 can suppress the amount by which a low-temperature and low-pressure refrigerant flowing out from the expansion device flows into the intermediate heat exchanger. However, in this case as well, the low-temperature and low-pressure refrigerant flows into the intermediate heat exchanger, and measures against freezing of the heat medium in the secondary side loop are not sufficient. Freezing of the heat medium in the secondary side loop may disturb circulation of the heat medium to the indoor unit, and air conditioning efficiency may be reduced. Also, because of the circulation of the heat medium being disturbed, the pressure of the heat medium pipe increases, which may lead to breakage of the pipe, and accordingly, there is a demand for more comprehensive consideration for safety.

That is to say, carrying out a defrost operation while applying the technology disclosed in Patent Literature 2 to the technology disclosed in Patent Literature 1 may lead to reduction of the operation reliability of the air-conditioning apparatus.

An air-conditioning apparatus according to the present invention aims at providing an air-conditioning apparatus configured to suppress freezing of a heat medium, an antifreeze, and the like is during the defrost operation to improve operation reliability.

Solution to Problem

An air-conditioning apparatus according to the present invention includes: an outdoor unit including a compressor, a first refrigerant flow path switching device, and a heat-source-side heat exchanger; a heat medium relay unit including an intermediate heat exchanger, an expansion device, a second refrigerant flow path switching device, and a pump; and at least one indoor unit including a use-side heat exchanger. The compressor, the first refrigerant flow path switching device, the expansion device, the second refrigerant flow path switching device, and the intermediate heat exchanger are connected using a refrigerant pipe, thereby making up a refrigeration cycle. The intermediate heat exchanger and the use-side heat exchanger are connected using a heat medium pipe, thereby making up a heat medium circulation circuit in which a heat medium different from the refrigerant circulates. The first refrigerant flow path switching device is switched to execute a defrost operation mode in which a refrigerant discharged from the compressor is supplied to the heat-source-side heat exchanger. During the defrost operation mode, part of a refrigerant flowing out from the heat-source-side heat exchanger is supplied to the intermediate heat exchanger without passing through the expansion device, and the rest of the refrigerant is returned to the outdoor unit without passing through the expansion device and the intermediate heat exchanger.

Advantageous Effects of Invention

In an air-conditioning apparatus according to the present invention, during a defrost operation mode, a refrigerant flowing into a heat medium exchanger from an outdoor unit is supplied to an intermediate heat exchanger from a side that is not connected to an expansion device. Thus, the air-conditioning apparatus according to the present invention suppresses evaporation of a refrigerant flowing into the intermediate heat exchanger, so that freezing of a heat medium, an antifreeze, or the like can be suppressed. Thus, the air-conditioning apparatus according to the present invention can be configured such that the operation reliability of the air-conditioning apparatus can be improved.

DESCRIPTION OF EMBODIMENT

Hereinafter, Embodiment of the present invention will be described based on the drawings.

An air-conditioning apparatus according to Embodiment has been improved to reduce the amount of a low-temperature refrigerant that is to flow into a heat exchanger (intermediate heat exchanger 15) which performs heat exchange between the refrigerant and a heat medium during a defrost operation. First, an installation example of the air-conditioning apparatus will be described based on FIG. 1.

Figure 1:
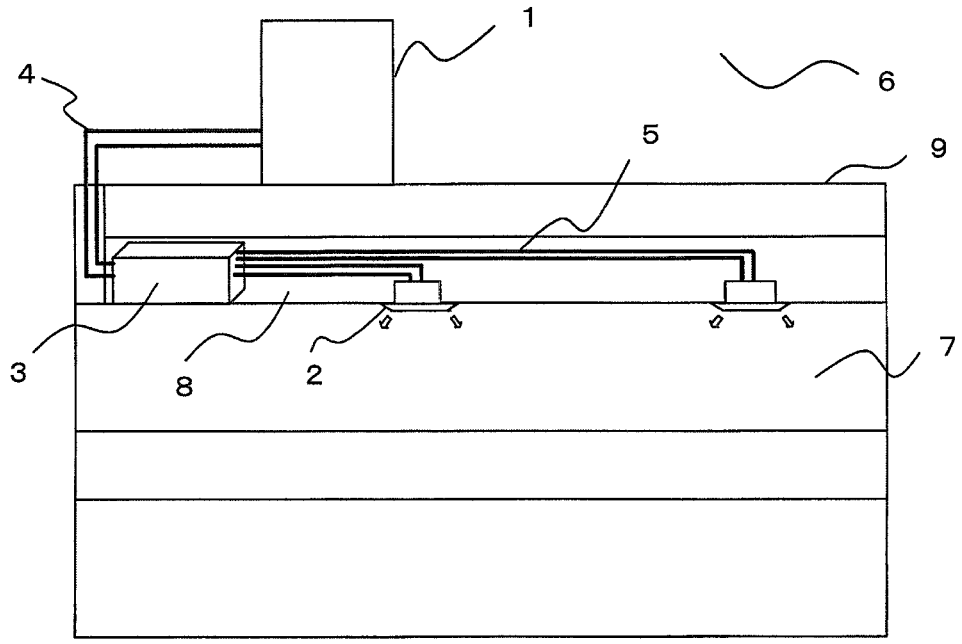
FIG. 1 is a schematic diagram illustrating an installation example of an air-conditioning apparatus according to Embodiment of the present invention.

FIG. 1 is a schematic diagram illustrating an installation example of an air-conditioning apparatus according to Embodiment of the present invention. This air-conditioning apparatus includes a refrigerant circuit A configured to circulate a refrigerant (heat-source-side refrigerant), and a heat medium circulation circuit B configured to circulate a heat medium. An indoor unit 2 is capable of freely selecting a cooling mode or a heating mode as an operation mode.

The air-conditioning apparatus employs a method for indirectly utilizing a refrigerant (indirect method). Specifically, the air-conditioning apparatus transfers cooling energy or heating energy saved in a heat source side refrigerant to a refrigerant different from the heat-source-side refrigerant (hereinafter, referred to as a heat medium), and cools or heats a space to be air-conditioned using the cooling energy or heating energy accumulated in the heat medium.

As illustrated in FIG. 1, the air-conditioning apparatus according to Embodiment includes one outdoor unit 1 which is a heat source, multiple indoor units 2, and a heat medium relay unit 3 which intervenes between the outdoor unit 1 and the indoor units 2. The heat medium relay unit 3 performs heat exchange between the heat source side refrigerant and the heat medium. The outdoor unit 1 and the heat medium relay unit 3 are connected by a refrigerant pipe 4 configured to circulate the heat-source-side refrigerant. The heat medium relay unit 3 and the indoor units 2 are connected by a pipe (heat medium pipe) 5 configured to circulate the heat medium. The cooling energy or heating energy generated in the outdoor unit 1 is distributed to the indoor units 2 via the heat medium relay unit 3.

The outdoor unit 1 is usually disposed in an outdoor space 6 which is a space outside a building 9 (for example, a rooftop or the like), and is configured to supply cooling energy or heating energy to the indoor units 2 via the heat medium relay unit 3.

The indoor units 2 are disposed at positions where the cooling air or heating air can be supplied to an indoor space 7 which is a space within the building 9 (for example, a living room or the like), and supply the cooling air or heating air to the indoor space 7 that is the space to be air-conditioned.

The heat medium relay unit 3 has a separate casing from the outdoor unit 1 and indoor units 2, and is installed at a position different from the outdoor space 6 and the indoor space 7. This heat medium relay unit 3 is connected to each of the outdoor unit 1 and the indoor units 2 via the refrigerant pipe 4 and the pipe 5, and transfers the cooling energy or heating energy supplied from the outdoor unit 1 to the indoor units 2.

As illustrated in FIG. 1, the air-conditioning apparatus according to Embodiment, the outdoor unit 1 and the heat medium relay unit 3 are connected via two refrigerant pipes 4, and the heat medium relay unit 3 and the indoor units 2*a* to 2*d* are connected via two pipes 5. Thus, the installation of the air-conditioning apparatus according to Embodiment is facilitated by connecting the units (outdoor unit 1, indoor units 2, and heat medium relay unit 3) via the refrigerant pipe 4 and the pipe 5.

Note that FIG. 1 exemplifies a state in which the heat medium relay unit 3 is installed in a space such as above the ceiling, which is inside the building 9 but different from the indoor space 7 (for example, a space such as above the ceiling in the building 9; hereinafter, simply referred to as a space 8). The heat medium relay unit 3 may be installed in a shared space such as an elevator hall or any other space. Also, FIG. 1 exemplifies a case where the indoor units 2 are of a ceiling cassette type, but the indoor units 2 are not restricted to this type. Specifically, the air-conditioning apparatus according to Embodiment may be of any type as long as the heating air or cooling air is blown out to the indoor space 7 directly or via a duct or the like. Examples include a ceiling concealed type, a ceiling suspended type, and so forth.

Also, FIG. 1 exemplifies a case where the outdoor unit 1 is installed in the outdoor space 6, but Embodiment is not restricted to this. For example, the outdoor unit 1 may be installed in surrounded space such as a machine room having ventilation openings or the like, or may be installed within the building 9 as long as waste heat can be discharged outside the building 9 through an exhaust duct. Also, in the case where a water-cooled outdoor unit 1 is employed, this may be installed within the building 9. Installation of the outdoor unit 1 in this sort of place poses no problems in particular.

Also, the heat medium relay unit 3 may be installed near the outdoor unit 1. However, it should be noted that when the distances from the heat medium relay unit 3 to the indoor units 2 are too long, power to transport the heat medium significantly increases, resulting in a reduction in energy-saving effects. Further, the numbers of connected outdoor units 1, indoor units 2, and heat medium relay units 3 are not restricted to those illustrated in FIG. 1, and, for example, the numbers of units may be decided according to the building 9 where the air-conditioning apparatus according to Embodiment is installed.

Figure 2:
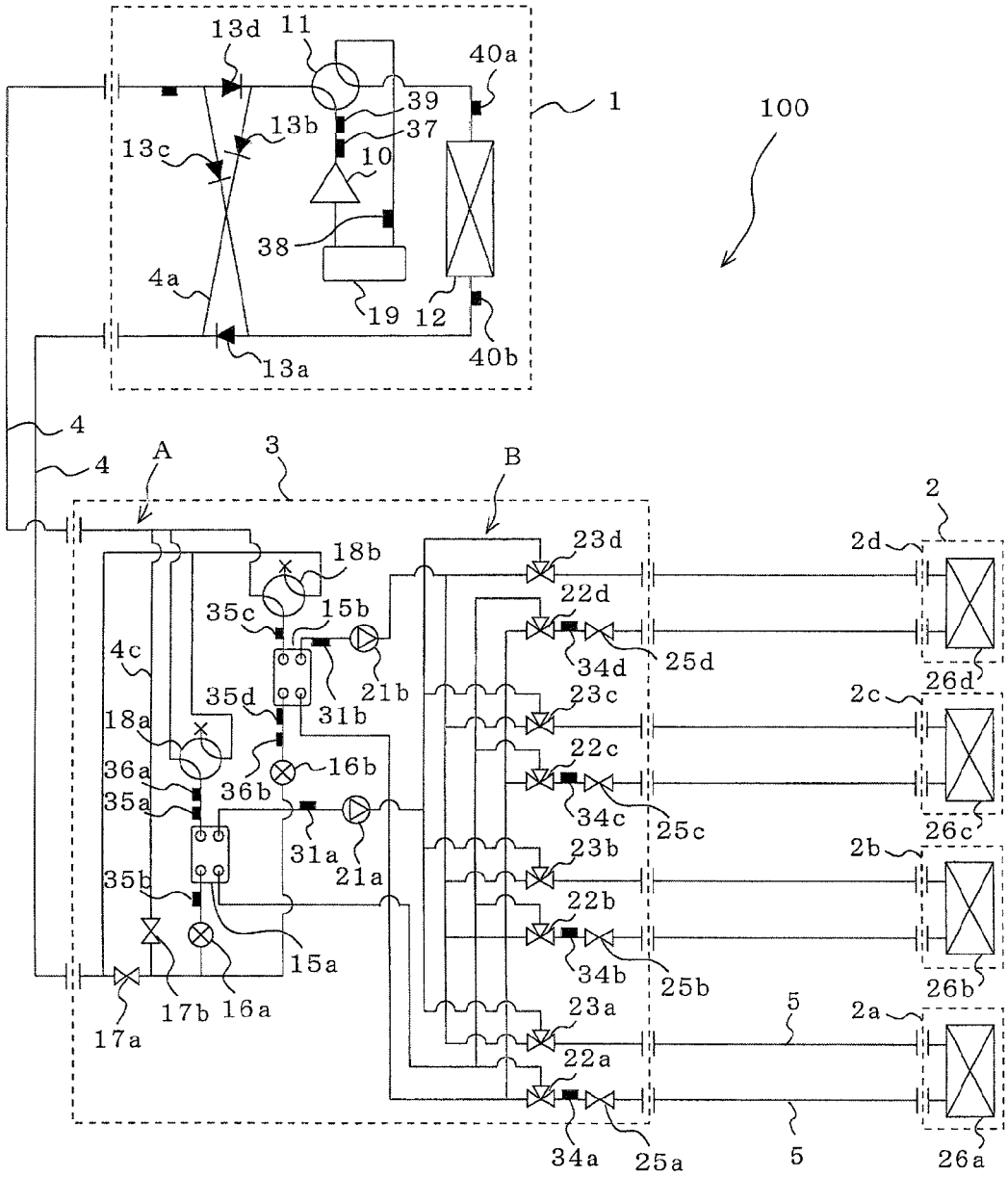
FIG. 2 is an example configuration of a refrigerant circuit of an air-conditioning apparatus according to Embodiment of the present invention.

FIG. 2 illustrates an example configuration of a refrigerant circuit of the air-conditioning apparatus according to Embodiment of the present invention (hereinafter, referred to as an air-conditioning apparatus 100). A detailed configuration of the air-conditioning apparatus 100 will be described with reference to FIG. 2. As illustrated in FIG. 2, the outdoor unit 1 and the heat medium relay unit 3 are connected by the refrigerant pipe 4 via an intermediate heat exchanger 15*a* and an intermediate heat exchanger 15*b* which are provided in the heat medium relay unit 3. Also, both of the heat medium relay unit 3 and the indoor units 2 are connected by the pipe 5 via the intermediate heat exchangers 15*a* and 15*b*. Note that the refrigerant pipe 4 will be described later in detail.

[Outdoor Unit 1]

The outdoor unit 1 has a compressor 10 to compress a refrigerant, a first refrigerant flow path switching device 11 configured as a four-way valve or the like, a heat-source-side heat exchanger 12 configured to serve as an evaporator or a condenser, and an accumulator 19 to save surplus refrigerant, which are connected to the refrigerant pipe 4.

Also, the outdoor unit 1 has a first connection pipe 4*a*, a second connection pipe 4*b*, a check valve 13*a*, a check valve 13*b*, a check valve 13*c*, and a check valve 13*d*. The flow of a heat-source-side refrigerant flowing into the heat medium relay unit 3 can be directed in a certain direction regardless of an operation requested from the indoor units 2 by providing the first connection pipe 4*a*, the second connection pipe 4*b*, the check valve 13*a*, the check valve 13*b*, the check valve 13*c*, and the check valve 13*d*. That is to say, a refrigerant that is to flow out from the outdoor unit 1 flows out from the outdoor unit 1 via the refrigerant pipe 4 connected to the check valves 13*a* and 13*b* (first refrigerant pipe). A refrigerant that is to flow into the outdoor unit 1 from the heat medium relay unit 3 flows into the outdoor unit 1 via the refrigerant pipe 4 connected to the check valves 13*c* and 13*d* (second refrigerant pipe).

Further, the outdoor unit 1 includes a first outdoor temperature sensor 40*a* configured to detect the temperature of the refrigerant flowing into the heat-source-side heat exchanger 12, and a second outdoor temperature sensor 40*b* configured to detect the temperature of the refrigerant flowing out from the heat-source-side heat exchanger 12, during a defrost operation for removing frost generated in the heat-source-side heat exchanger 12.

The compressor 10 is configured to suck a heat-source-side refrigerant, and to compress the heat-source-side refrigerant into a high-temperature and high-pressure state, and may be configured as an inverter compressor capable of capacity control or the like, for example.

The first refrigerant flow path switching device 11 switches between the flow of a heat-source-side refrigerant during a heating operation mode (during a heating only operation mode and during a heating main operation mode) and the flow of a heat-source-side refrigerant during a cooling operation mode (during a cooling only operation mode and during a cooling main operation mode).

The heat-source-side heat exchanger 12 serves as an evaporator during a heating operation, and as a radiator (gas cooler) during a cooling operation, and performs heat exchange between the air supplied from an air-sending device such as a fan which is not illustrated and a heat-source-side refrigerant.

The accumulator 19 is provided on the suction side of the compressor 10, and is configured to save surplus refrigerant generated due to a difference between the heating operation mode and the cooling operation mode, and surplus refrigerant generated due to a transitional change of the operations (for example, a change in the number of running indoor units 2) or load conditions.

The first outdoor temperature sensor 40*a* detects the temperature of a refrigerant flowing into the heat-source-side heat exchanger 12 (entrance-side temperature). This first outdoor temperature sensor 40*a* is preferably provided in the refrigerant pipe 4 on the entrance side of the heat-source-side heat exchanger 12.

The second outdoor temperature sensor 40*b* is configured to detect the temperature of a refrigerant that has flowed out from the heat-source-side heat exchanger 12 (outlet-side temperature). This second outdoor temperature sensor 40*b* may be provided in the refrigerant pipe 4 on the outlet side of the heat-source-side heat exchanger 12.

The first outdoor temperature sensor 40*a* and the second outdoor temperature sensor 40*b* are connected to a controller 70 configured to perform overall control of the operation of the air-conditioning apparatus 100. The detection results of the first outdoor temperature sensor 40*a* and the second outdoor temperature sensor 40*b* are transmitted to the controller 70, and the controller 70 determines whether or not the controller 70 implements a defrost operation for the heat-source-side heat exchanger 12. Note that each of the first outdoor temperature sensor 40*a* and the second outdoor temperature sensor 40*b* may be configured as a thermistor or the like, for example.

[Indoor Unit 2]

A use-side heat exchanger 26 is mounted in each of the indoor units 2. The use-side heat exchanger 26 is connected to a heat medium flow control device 25 and a second heat medium flow path switching device 23 of the heat medium relay unit 3 by pipes 5. The use-side heat exchanger 26 is configured to perform heat exchange between the air supplied from the air-sending device such as a fan which is not illustrated and a heat medium, and to generate the heating air or cooling air to be supplied to the indoor space 7.

FIG. 2 exemplifies a case where four indoor units 2 are connected to the heat medium relay unit 3, and illustrates these as an indoor unit 2*a*, an indoor unit 2*b*, an indoor unit 2*c*, and an indoor unit 2*d* from the lower side of the drawing. Also, the use-side heat exchangers 26 are also illustrated as a use-side heat exchanger 26*a*, a use-side heat exchanger 26*b*, a use-side heat exchanger 26*c*, and a use-side heat exchanger 26*d*, from the lower side of the drawing, in accordance with the indoor units 2*a* to 2*d*. Note that the number of connected indoor units 2 is not restricted to four illustrated in FIG. 2.

[Heat Medium Relay Unit 3]

The heat medium relay unit 3 includes two intermediate heat exchangers 15 (15*a* and 15*b*) that performs heat exchange between a refrigerant and a heat medium, and two expansion devices 16 (16*a* and 16*b*) to decrease the pressure of a refrigerant. The heat medium relay unit 3 also includes two opening/closing devices 17 (17*a* and 17*b*) configured to open/close a flow path of the refrigerant pipe 4, two second refrigerant flow path switching devices 18 (18*a* and 18*b*) configured to switch a refrigerant path, and two pumps 21 (21*a* and 21*b*) configured to circulate a heat medium. The heat medium relay unit 3 further includes four first heat medium flow path switching devices 22 (22*a* to 22*d*) to be connected to one of the pipes 5, four second heat medium flow path switching devices 23 (23*a* to 23*d*) to be connected to the other of the pipes 5, and four heat medium flow control devices 25 (25*a* to 25*d*) to be connected to the one of the pipes 5 to which the second heat medium flow path switching devices 22 are to be connected.

The two intermediate heat exchangers 15*a* and 15*b* serve as condensers (radiators) or evaporators, and are configured to perform heat exchange between a heat-source-side refrigerant and a heat medium, and to transfer, to the heat medium, cooling energy or heating energy generated in the outdoor unit 1 and saved in the heat-source-side refrigerant. The intermediate heat exchanger 15*a* is provided between the expansion device 16*a* and the second refrigerant flow path switching device 18*a* in the refrigerant circuit A, and serves to cool a heat medium during a cooling and heating mixed operation mode. The intermediate heat exchanger 15*b* is provided between the expansion device 16*b* and the second refrigerant flow path switching device 18*b* in the refrigerant circuit A, and serves to heat a heat medium during the cooling and heating mixed operation mode.

The two expansion device 16*a* and 16*b* have a function to serve as a pressure reducing valve or an expansion valve, and are configured to reduce the pressure of a heat-source-side refrigerant and expand the heat-source-side refrigerant. The expansion device 16*a* is provided on the upstream side of the intermediate heat exchanger 15*a* in the flow of a heat-source-side refrigerant during the cooling only operation mode. The expansion device 16*b* is provided on the upstream side of the intermediate heat exchanger 15*b* in the flow of a heat-source-side refrigerant during the cooling only operation mode. Each of the two expansion devices 16 may be constituted by a device of which the opening degree can be variably controlled, such as an electronic expansion valve.

The two opening/closing devices 17*a* and 17*b* are configured as two-way valves or the like, and are configured to open/close the refrigerant pipe 4. That is to say, the opening/dosing operation performed by the two opening/dosing devices 17*a* and 17*b* is controlled according to later-described operation modes, in order to control the flow of a refrigerant supplied from the refrigerant pipe 4 (first refrigerant pipe).

The two second refrigerant flow path switching devices 18*a* and 18*b* are configured as four-way valves or the like, and are configured to switch the flow of a heat-source-side refrigerant according to operation modes. The second refrigerant flow path switching device 18*a* is provided on the downstream side of the intermediate heat exchanger 15*a* in the flow of a heat-source-side refrigerant during the cooling only operation mode. The second refrigerant flow path switching device 18*b* is provided on the downstream side of the intermediate heat exchanger 15*b* in the flow of a heat-source-side refrigerant during the cooling only operation mode.

Note that the second refrigerant flow path switching devices 18 may not necessarily be four-way valves, and may be configured using a three-way valve, a two-way valve, and a solenoid valve in combination.

The two pumps 21*a* and 21*b* circulate a heat medium within the pipe 5. The pump 21*a* is provided in the pipe 5 between the intermediate heat exchanger 15*a* and the second heat medium flow path switching devices 23. The pump 21*b* is provided in the pipe 5 between the intermediate heat exchanger 15*b* and the second heat medium flow path switching devices 23. These pumps 21 may be configured as capacity-controllable pumps or the like, for example. Note that the pump 21*a* may be provided in the pipe 5 between the intermediate heat exchanger 15*a* and the first heat medium flow path switching devices 22. Also, the pump 21*b* may be provided in the pipe 5 between the intermediate heat exchanger 15*b* and the first heat medium flow path switching devices 22.

The four first heat medium flow path switching devices 22*a* to 22*d* are configured as three-way valves or the like, and are configured to switch the flow path of a heat medium.

The number of first heat medium flow path switching devices 22 to be provided is determined in accordance with the number of installed indoor units 2 (here, four). In each of the first heat medium flow path switching devices 22, one of the three ways is connected to the intermediate heat exchanger 15*a*, one to the intermediate heat exchanger 15*b*, and one to the heat medium flow control devices 25. The first heat medium flow path switching devices 22 are on the outlet side of the heat medium flow path of the use-side heat exchangers 26. Note that the first heat medium flow path switching devices 22 are illustrated as the first heat medium flow path switching device 22*a*, the first heat medium flow path switching device 22*b*, the first heat medium flow path switching device 22*c*, and the first heat medium flow path switching device 22*d*, from the lower side of the drawing, in accordance with the indoor units 2.

The four second heat medium flow path switching devices 23*a* to 23*d* are configured as three-way valves or the like, and are configured to switch the flow path of a heat medium. The number of second heat medium flow path switching devices 23 to be provided is determined in accordance with the number of installed indoor units 2 (here, four). In each of the second heat medium flow path switching devices 23, one of the three ways is connected to the intermediate heat exchanger 15*a*, one to the intermediate heat exchanger 15*b*, and one to the use-side heat exchangers 26. The second heat medium flow path switching devices 23, and are provided on the entrance sides of the heat member flow paths of the use-side heat exchangers 26. Note that the second heat medium flow path switching devices 23 are illustrated as the second heat medium flow path switching device 23*a*, the second heat medium flow path switching device 23*b*, the second heat medium flow path switching device 23*c*, and the second heat medium flow path switching device 23*d*, from the lower side of the drawing, in correspondence with the indoor units 2.

The four heat medium flow control devices 25*a* to 25*d* are configured as two-way valves or the like which can control the area of the opening, and are configured to control the flow rate of a heat medium flowing into the pipe 5. The number of heat medium flow control devices 25 to be provided is determined in accordance with the number of installed indoor units 2 (here, four). In each of the heat medium flow control devices 25, one of the two ways is connected to the use-side heat exchangers 26, and the other to the first heat medium flow path switching devices 22. The heat medium flow control devices 25 are provided on the outlet sides of the heat member flow paths of the use-side heat exchangers 26. Note that the heat medium flow control devices 25 are illustrated as the heat medium flow control device 25*a*, the heat medium flow control device 25*b*, the heat medium flow control device 25*c*, and the heat medium flow control device 25*d*, from the lower side of the drawing, in accordance with the indoor units 2. Also, the heat medium flow control devices 25 may be provided on the entrance sides of the heat medium flow paths of the use-side heat exchangers 26.

Also, the heat medium relay unit 3 includes various detecting means (two first temperature sensors 31 (31*a* and 31*b*), four second temperature sensors 34 (34*a* to 34*d*), four third temperature sensors 35 (35*a* to 35*d*), and two pressure sensors 36 (36*a* and 36*b*)). Information detected by these detecting means (for example, temperature information, pressure information, and density information of a heat-source-side refrigerant) is transmitted to the controller 70 configured to perform overall control of the operation of the air-conditioning apparatus 100. The information is used for controlling the driving frequency of the compressor 10, the rotation speed of the air-sending device (omitted from illustration) provided in the vicinity of the heat-source-side heat exchanger 12 and the use-side heat exchangers 26, the switching operation of the first refrigerant flow path switching device 11, the driving frequency of the pumps 21, the switching operation of the second refrigerant flow path switching devices 18, the switching operation of the first heat medium flow path switching devices 22, the switching operation of the second heat medium flow path switching devices, and so forth.

The two first temperature sensors 31*a* to 31*b* are configured to detect the temperature of a heat medium flowing out from the intermediate heat exchangers 15, that is, the temperature of the heat medium at the exits of the intermediate heat exchangers 15, and may be configured as thermistors or the like. The first temperature sensor 31*a* is provided in the pipe 5 on the entrance side of the pump 21*a*. The first temperature sensor 31*b* is provided in the pipe 5 on the entrance side of the pump 21*b*.

The four second temperature sensors 34*a* to 34*d* are provided between the first heat medium flow path switching devices 22 and the heat medium flow control devices 25, and are configured to detect the temperature of the heat medium flowing out from the use-side heat exchanger 26, and may be configured as thermistors or the like. The number of second temperature sensors 34 to be provided is determined in accordance with the number of installed indoor units 2 (here, four). Note that the second temperature sensors 34 are illustrated as the second temperature sensor 34*a*, the second temperature sensor 34*b*, the second temperature sensor 34*c*, and the second temperature sensor 34*d*, from the lower side of the drawing, in accordance with the indoor units 2.

The four third temperature sensors 35*a* to 35*d* are provided on the heat-source-side refrigerant entrance sides or outlet sides of the intermediate heat exchangers 15, and detect the temperature of heat-source-side refrigerants flowing into the intermediate heat exchangers 15, or the temperature of heat-source-side refrigerants flowing out from the intermediate heat exchangers 15, and may be configured as thermistors or the like. The third temperature sensor 35*a* is provided between the intermediate heat exchanger 15*a* and the second refrigerant flow path switching device 18*a*. The third temperature sensor 35*b* is provided between the intermediate heat exchanger 15*a* and the expansion device 16*a*. The third temperature sensor 35*c* is provided between the intermediate heat exchanger 15*b* and the second refrigerant flow path switching device 18*b*. The third temperature sensor 35*d* is provided between the intermediate heat exchanger 15*b* and the expansion device 16*b*.

The two pressure sensors 36*a* and 36*b* detect the pressure of a refrigerant. The pressure sensor 36*a* detects, in the same way as the installation position of the third temperature sensor 35*a*, the pressure of a heat-source-side refrigerant flowing between the intermediate heat exchanger 15*a* and the second refrigerant flow path switching device 18*a*. Also, the pressure sensor 36*b* is, in the same way as the installation position of the third temperature sensor 35*d*, provided between the intermediate heat exchanger 15*b* and the expansion device 16*b*, and detects the pressure of a heat-source-side refrigerant flowing between the intermediate heat exchanger 15*b* and the expansion device 16*b*.

The controller 70 is configured as a microcomputer or the like, and controls, based on the detection information at the various detecting means and instructions from a remote controller, the driving frequency of the compressor 10, the rotation speed (including on/off) of the air-sending device, the switching operation of the first refrigerant flow path switching device 11, the driving of the pumps 21, the opening degrees of the expansion devices 16, the opening/closing operation of the opening/closing devices 17, the switching operation of the second refrigerant flow path switching devices 18, the switching operation of the first heat medium flow path switching devices 22, the switching operation of the second heat medium flow path switching devices 23, the opening degrees of the heat medium flow control devices 25, and so forth. That is to say, the controller 70 performs overall control on various devices to execute a defrost operation and each of the operation modes, described later. FIG. 2 illustrates an example wherein the controller 70 is provided in the heat medium relay unit 3, but the location of the controller 70 is not restricted to this. That is to say, the controller 70 may be provided for each of the indoor units 2 or may be provided in the heat medium relay unit 3. Alternatively, an arrangement may be made wherein multiple controllers 70 are provided in the outdoor unit 1, the indoor units 2, and the heat medium relay unit 3, and are configured so as to perform cooperative control by communication.

The pipe 5 configured to circulate a heat medium is constituted by a pipe to be connected to the intermediate heat exchanger 15*a*, and a pipe to be connected to the intermediate heat exchanger 15*b*. The pipe 5 branches (here, into four) according to the number of indoor units 2 to be connected to the heat medium relay unit 3. The pipe 5 is connected at the first heat medium flow path switching devices 22 and the second heat medium flow path switching devices 23. The first heat medium flow path switching devices 22 and the second heat medium flow path switching devices 23 are controlled, whereby determination is made regarding whether to make the heat medium from the intermediate heat exchanger 15*a* flow into the use-side heat exchangers 26 or whether to make the heat medium from the intermediate heat exchanger 15*b* flow into the use-side heat exchangers 26.

In the air-conditioning apparatus 100, the compressor 10, the first refrigerant flow path switching device 11, the heat-source-side heat exchanger 12, the opening/closing devices 17, the second refrigerant flow path switching devices 18, the refrigerant flow paths of the intermediate heat exchangers 15, the expansion devices 16, and the accumulator 19 are connected by the refrigerant pipe 4 to make up the refrigerant circuit A. Also, the heat medium flow paths of the intermediate heat exchangers 15, the pumps 21, the first heat medium flow path switching devices 22, the heat medium flow control devices 25, the use-side heat exchangers 26, and the second heat medium flow path switching devices 23 are connected by the pipe 5 to make up the heat medium circulation circuit B. That is to say, the multiple use-side heat exchangers 26 are connected in parallel to each of the intermediate heat exchangers 15, thereby providing the heat medium circulation circuit B of multiple systems.

Accordingly, in the air-conditioning apparatus 100, the outdoor unit 1 and the heat medium relay unit 3 are connected via the heat exchangers 15 provided in the heat medium relay unit 3, and the heat medium relay unit 3 and indoor units 2 are also connected via the intermediate heat exchangers 15. That is to say, in the air-conditioning apparatus 100, heat exchange is performed in the intermediate heat exchanger 15*a* and the intermediate heat exchanger 15*b* between a heat-source-side refrigerant which circulates in the refrigerant circuit A and a heat medium which circulates in the heat medium circulation circuit B.

[Description of Operation Modes]

Next, the operation modes that the air-conditioning apparatus 100 executes will be described. This air-conditioning apparatus 100 is capable of performing a cooling operation or a heating operation in the indoor units 2, based on instructions from the indoor units 2. That is to say, the air-conditioning apparatus 100 is capable of performing the same operation in all of the indoor units 2 or performing different operations in the indoor units 2.

The air-conditioning apparatus 100 executes operation modes including a cooling only operation mode wherein all of the driven indoor units 2 execute a cooling operation, a heating only operation mode wherein all of the driven indoor units 2 execute a heating operation, a cooling main operation mode as a cooling and heating mixed operation mode wherein cooling load is greater, and a heating main operation mode as a cooling and heating mixed operation mode wherein heating load is the greater. In addition to these four normal operations, the air-conditioning apparatus 100 according to Embodiment 1 also executes a defrost operation mode wherein frost adhering to the heat-source-side heat exchanger 12 is removed.

Hereinafter, the operation modes will be described along with the flows of a heat-source-side refrigerant and a heat medium.

[Cooling Only Operation Mode]

Figure 3:
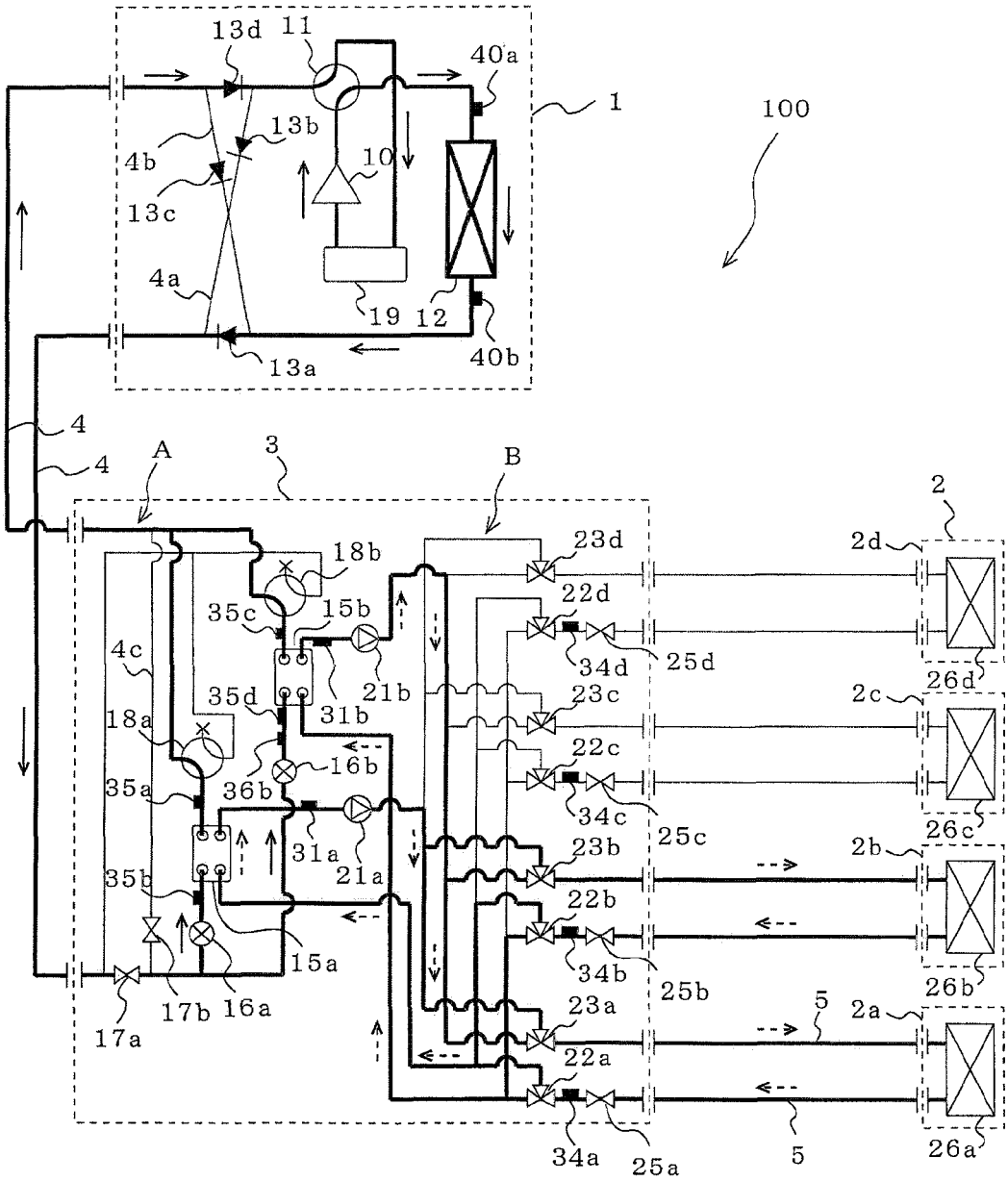
FIG. 3 is a refrigerant circuit diagram illustrating a flow of a refrigerant during a cooling only operation mode of the air-conditioning apparatus illustrated in FIG. 2.

FIG. 3 is a refrigerant circuit diagram illustrating the flow of a refrigerant during the cooling only operation mode of the air-conditioning apparatus 100. In FIG. 3, the cooling only operation mode will be exemplarily described with a case where cooling load is generated only in the use-side heat exchanger 26*a* and the use-side heat exchanger 26*b*. Note that in FIG. 3, a pipe represented with a thick line indicates a pipe through which a refrigerant (heat-source-side refrigerant and heat medium) flows. Also, in FIG. 3, a solid-line arrow indicates a flow direction of a heat-source-side refrigerant, and a dashed-line arrow indicates a flow direction of a heat medium.

In the case of the cooling only operation mode illustrated in FIG. 3, the first refrigerant flow path switching device 11 of the outdoor unit 1 is switched so that the heat-source-side refrigerant discharged from the compressor 10 flows into the heat-source-side heat exchanger 12. In the heat medium relay unit 3, the pump 21*a* and the pump 21*b* are driven to open the heat medium flow control device 25*a* and the heat medium flow control device 25*b* and to fully close the heat medium flow control device 25*c* and the heat medium flow control device 25*d*, thereby allowing a heat medium to circulate between each of the intermediate heat exchangers 15*a* and 15*b* and the use-side heat exchanger 26*a*, and between each of the intermediate heat exchangers 15*a* and 15*b* and the use-side heat exchanger 26*b*.

First, the flow of a heat-source-side refrigerant in the refrigerant circuit A will be described.

A low-temperature and low-pressure refrigerant is compressed by the compressor 10, and is discharged as a high-temperature and high-pressure gas refrigerant. The high-temperature and high-pressure gas refrigerant discharged from the compressor 10 flows into the heat-source-side heat exchanger 12 via the first refrigerant flow path switching device 11, and becomes a high-pressure liquid refrigerant while transferring heat to the outdoor air in the heat-source-side heat exchanger 12. The high-pressure refrigerant that has flowed out from the heat-source-side heat exchanger 12 passes through the check valve 13*a*, flows out from the outdoor unit 1, passes through the refrigerant pipe 4, and flows into the heat medium relay unit 3. The flow of the high-pressure refrigerant that has flowed into the heat medium relay unit 3 is divided after the high-pressure refrigerant passes through the opening/closing device 17*a*. The high-pressure refrigerant is expanded in the expansion device 16*a* and the expansion device 16*b*, and becomes a low-temperature and low-pressure two-phase refrigerant. Note that the opening/dosing device 17*b* is in a closed state.

This two-phase refrigerant flows into each of the intermediate heat exchanger 15*a* and the intermediate heat exchanger 15*b* which serve as evaporators, absorbs heat from the heat medium which circulates in the heat medium circulation circuit B, and becomes a low-temperature and low-pressure gas refrigerant while cooling the heat medium. The gas refrigerant that has flowed out from the intermediate heat exchanger 15*a* and the intermediate heat exchanger 15*b* passes through the refrigerant pipe 4 via the second refrigerant flow path switching device 18*a*, the second refrigerant flow path switching device 18*b*, and the heat medium relay unit 3, and flows into the outdoor unit 1 again. The refrigerant that has flowed into the outdoor unit 1 passes through the check valve 13*d* and is sucked into the compressor 10 again via the first refrigerant flow path switching device 11 and the accumulator 19.

At this time, the second refrigerant flow path switching device 18*a* and the second refrigerant flow path switching device 18*b* are made to communicate with the low-pressure pipe. Also, the opening degree of the expansion device 16*a* is controlled so that the superheat (degree of superheat) obtained as a difference between the temperature detected by the third temperature sensor 35*a* and the temperature detected by the third temperature sensor 35*b* becomes constant. Similarly, the opening degree of the expansion device 16*b* is controlled so that the superheat obtained as a difference between the temperature detected by the third temperature sensor 35*c* and the temperature detected by the third temperature sensor 35*d* becomes constant.

Next, the flow of a heat medium in the heat medium circulation circuit B will be described.

In the cooling only operation mode, cooling energy of a heat-source-side refrigerant is transferred to the heat medium in both of the intermediate heat exchanger 15*a* and the intermediate heat exchanger 15*b*, and the cooled heat medium flows within the pipe 5 by the pump 21*a* and the pump 21*b*. The heat medium that has been pressurized by the pump 21*a* and the pump 21*b* and that has flowed out from the pump 21*a* and the pump 21*b* flows into the use-side heat exchanger 26*a* and the use-side heat exchanger 26*b* via the second heat medium flow path switching device 23*a* and the second heat medium flow path switching device 23*b*, respectively. The heat medium then absorbs heat from the indoor air in the use-side heat exchanger 26*a* and the use-side heat exchanger 26*b*, thereby cooling the indoor space 7.

The heat medium then flows out from the use-side heat exchanger 26*a* and the use-side heat exchanger 26*b* and flows into the heat medium flow control device 25*a* and the heat medium flow control device 25*b*. At this time, the flow rate of the heat medium is controlled by action of the heat medium flow control device 25*a* and the heat medium flow control device 25*b* so as to obtain a flow rate necessary for covering air conditioning load necessary for indoors, and the heat medium flows into the use-side heat exchanger 26*a* and the use-side heat exchanger 26*b*. The heat medium that has flowed out from the heat medium flow control device 25*a* and the heat medium flow control device 25*b* passes through the first heat medium flow path switching device 22*a* and the first heat medium flow path switching device 22*b*, flows into the intermediate heat exchanger 15*a* and the intermediate heat exchanger 15*b*, and is sucked into the pump 21*a* and the pump 21*b* again.

Note that in the pipe 5 of the use-side heat exchangers 26, the heat medium flows in a direction from the second heat medium flow path switching devices 23 to the first heat medium flow path switching devices 22 via the heat medium flow control devices 25. Also, air conditioning load necessary for the indoor space 7 can be covered by performing control so as to maintain the temperature detected by the first temperature sensor 31*a*, or a difference between the temperature detected by the first temperature sensor 31*b* and the temperature detected by the second temperature sensor 34 as a target value. The temperature detected by either the first temperature sensor 31*a* or the first temperature sensor 31*b*, or a mean temperature of these may be employed as the outlet temperature of the intermediate heat exchangers 15. At this time, the opening degree of the first heat medium flow path switching devices 22 and the second heat medium flow path switching devices 23 is set to an intermediate opening degree so as to secure a flow path flowing to both of the intermediate heat exchanger 15*a* and the intermediate heat exchanger 15*b*.

When the cooling only operation mode is executed, there is no need for the heat medium to flow into the use-side heat exchangers 26 (including thermo-off) having no heat load, and accordingly, the flow path is dosed by the heat medium flow control devices 25 so as to prevent the heat medium from flowing into the use-side heat exchangers 26. In FIG. 3, the use-side heat exchanger 26*a* and the use-side heat exchanger 26*b* have heat load, and accordingly, the heat medium flows thereinto. However, the use-side heat exchanger 26*c* and the use-side heat exchanger 26*d* have no heat load, and the corresponding heat medium flow control device 25*c* and the heat medium flow control device 25*d* are fully closed. In the case where heat load has been generated from the use-side heat exchanger 26*c* or the use-side heat exchanger 26*d*, the heat medium flow control device 25*c* or the heat medium flow control device 25*d* is opened to allow the heat medium to circulate.

[Heating Only Operation Mode]

Figure 4:
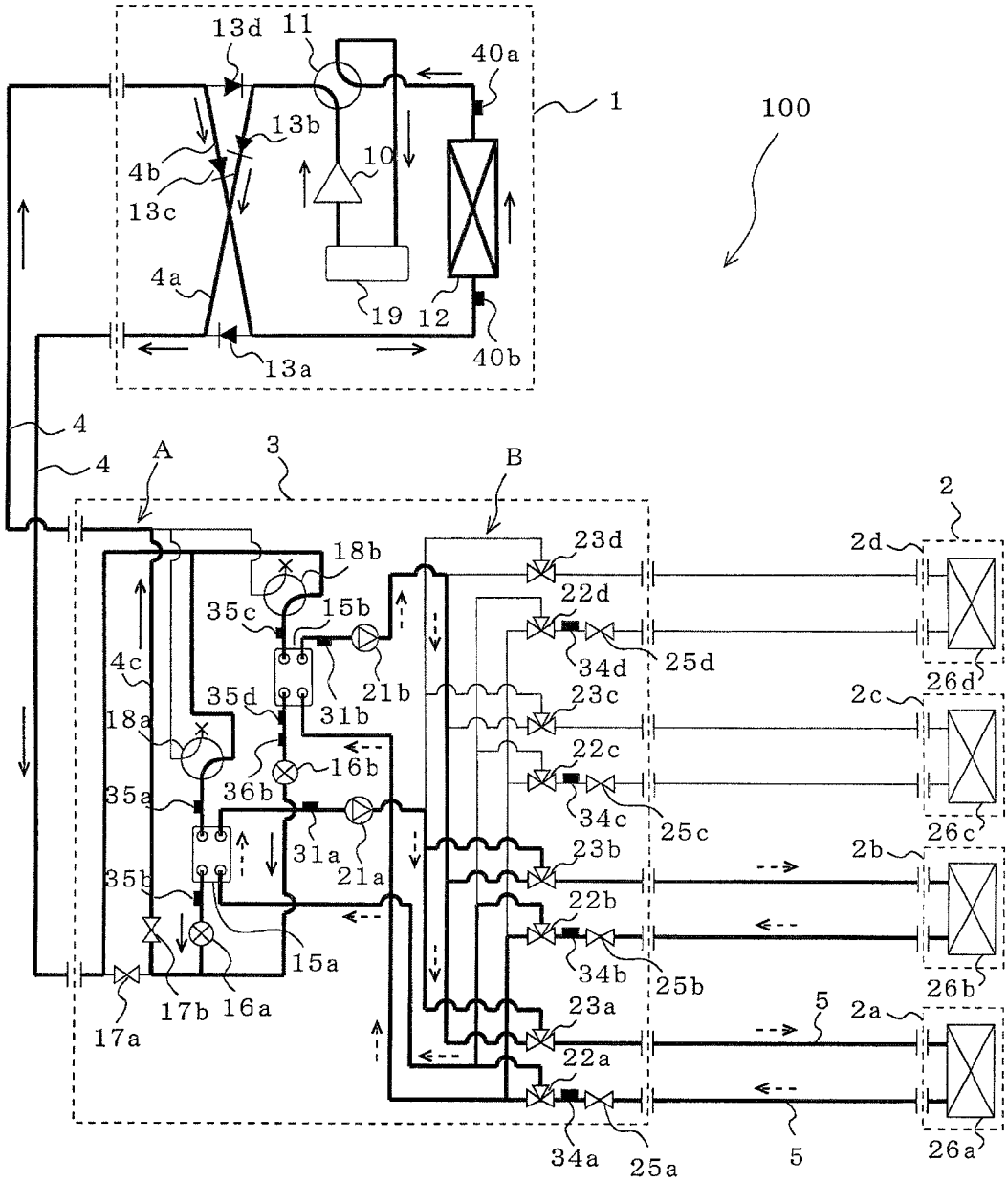
FIG. 4 is a refrigerant circuit diagram illustrating a flow of a refrigerant during a heating only operation mode of the air-conditioning apparatus illustrated in FIG. 2.

FIG. 4 is a refrigerant circuit diagram illustrating the flow of a refrigerant during the heating only operation mode of the air-conditioning apparatus 100. In FIG. 4, the heating only operation mode will be exemplarily described with a case where heating load is generated only in the use-side heat exchanger 26*a* and the use-side heat exchanger 26*b*. Note that in FIG. 4, a pipe represented with a thick line indicates a pipe through which a refrigerant (heat-source-side refrigerant and heat medium) flows. Also, in FIG. 4, a solid-line arrow indicates a flow direction of a heat-source-side refrigerant, and a dashed-line arrow indicates a flow direction of a heat medium.

In the case of the heating only operation mode illustrated in FIG. 4, the first refrigerant flow path switching device 11 of the outdoor unit 1 is switched so that the heat-source-side refrigerant discharged from the compressor 10 flows into the heat medium relay unit 3 without passing through the heat-source-side heat exchanger 12. In the heat medium relay unit 3, the pump 21*a* and the pump 21*b* are driven to open the heat medium flow control device 25*a* and the heat medium flow control device 25*b* and to fully close the heat medium flow control device 25*c* and the heat medium flow control device 25*d*, thereby allowing a heat medium to circulate between each of the intermediate heat exchangers 15*a* and 15*b* and the use-side heat exchanger 26*a*, and between each of the intermediate heat exchangers 15*a* and 15*b* and the use-side heat exchanger 26*b*.

First, the flow of a heat-source-side refrigerant in the refrigerant circuit A will be described.

A low-temperature and low-pressure refrigerant is compressed by the compressor 10, and is discharged as a high-temperature and high-pressure gas refrigerant. The high-temperature and high-pressure gas refrigerant discharged from the compressor 10 passes through the first refrigerant flow path switching device 11 and the check valve 13*b* and flows out from the outdoor unit 1. The high-temperature and high-pressure gas refrigerant that has flowed out from the outdoor unit 1 passes through the refrigerant pipe 4 and flows into the heat medium relay unit 3. The flow of the high-temperature and high-pressure gas refrigerant that has flowed into the heat medium relay unit 3 is divided. The high-temperature and high-pressure gas refrigerant passes through the second refrigerant flow path switching device 18*a* and the second refrigerant flow path switching device 18*b*, and flows into the intermediate heat exchanger 15*a* and the intermediate heat exchanger 15*b*.

The high-temperature and high-pressure gas refrigerant that has flowed into the intermediate heat exchanger 15*a* and the intermediate heat exchanger 15*b* becomes a high-pressure liquid refrigerant while transferring heat to the heat medium which circulates within the heat medium circulation circuit B. The liquid refrigerant that has flowed out from the intermediate heat exchanger 15*a* and the intermediate heat exchanger 15*b* is expanded in the expansion device 16*a* and the expansion device 16*b*, and becomes a low-temperature and low-pressure two-phase refrigerant. This two-phase refrigerant passes through the opening/closing device 17*b*, flows out from the heat medium relay unit 3, passes through the refrigerant pipe 4, and flows into the outdoor unit 1 again. Note that the opening/closing device 17*a* is in a closed state.

The refrigerant that has flowed into the outdoor unit 1 passes through the check valve 13*c*, and flows into the heat-source-side heat exchanger 12 which serves as an evaporator. The refrigerant that has flowed into the heat-source-side heat exchanger 12 absorbs heat from the outdoor air in the heat-source-side heat exchanger 12, and becomes a low-temperature and low-pressure gas refrigerant. The low-temperature and low-pressure gas refrigerant that has flowed out from the heat-source-side heat exchanger 12 is sucked into the compressor 10 via the first refrigerant flow path switching device 11 and the accumulator 19 again.

At this time, the second refrigerant flow path switching device 18*a* and the second refrigerant flow path switching device 18*b* are made to communicate with the high-pressure pipe. Also, the opening degree of the expansion device 16*a* is controlled so that the subcool (degree of subcooling) obtained as a difference between a value obtained by converting the pressure detected by the pressure sensor 36*a* into saturation temperature and the temperature detected by the third temperature sensor 35*b* becomes constant. Similarly, the opening degree of the expansion device 16*b* is controlled so that the subcool obtained as a difference between a value obtained by converting the pressure detected by the pressure sensor 36*b* in terms of saturation temperature and the temperature detected by the third temperature sensor 35*d* becomes constant. Note that, in the case where the temperature at an intermediate position of the intermediate heat exchangers 15 can be measured, the temperature at the intermediate position may be employed instead of the pressure sensor 36, and accordingly, the system can be built at low cost.

Next, the flow of a heat medium in the heat medium circulation circuit B will be described.

In the heating only operation mode, heating energy of a heat-source-side refrigerant is transferred to the heat medium in both of the intermediate heat exchanger 15*a* and the intermediate heat exchanger 15*b*, and the heated heat medium is made to flow within the pipe 5 by the pump 21*a* and the pump 21*b*. The heat medium that has been pressurized by the pump 21*a* and the pump 21*b* and that has flowed out from the pump 21*a* and the pump 21*b* flows into the use-side heat exchanger 26*a* and the use-side heat exchanger 26*b* via the second heat medium flow path switching device 23*a* and the second heat medium flow path switching device 23*b*, respectively. The heat medium then transfers heat to the indoor air in the use-side heat exchanger 26*a* and the use-side heat exchanger 26*b*, thereby heating the indoor space 7.

The heat medium then flows out from the use-side heat exchanger 26*a* and the use-side heat exchanger 26*b* and flows into the heat medium flow control device 25*a* and the heat medium flow control device 25*b*. At this time, the flow rate of the heat medium is controlled by action of the heat medium flow control device 25*a* and the heat medium flow control device 25*b* so as to obtain a flow rate necessary for covering air conditioning load necessary for indoors, and the heat medium flows into the use-side heat exchanger 26*a* and the use-side heat exchanger 26*b*. The heat medium that has flowed out from the heat medium flow control device 25*a* and the heat medium flow control device 25*b* passes through the first heat medium flow path switching device 22*a* and the first heat medium flow path switching device 22*b*, flows into the intermediate heat exchanger 15*a* and the intermediate heat exchanger 15*b*, and is sucked into the pump 21*a* and the pump 21*b* again.

Note that, in the pipe 5 of the use-side heat exchangers 26, the heat medium flows in a direction from the second heat medium flow path switching devices 23 to the first heat medium flow path switching devices 22 via the heat medium flow control devices 25. Also, air conditioning load necessary for the indoor space 7 can be covered by performing control so as to maintain the temperature detected by the first temperature sensor 31*a*, or a difference between the temperature detected by the first temperature sensor 31*b* and the temperature detected by the second temperature sensor 34 as a target value. The temperature detected by either the first temperature sensor 31*a* or the first temperature sensor 31*b*, or a mean temperature of these may be employed as the outlet temperature of the intermediate heat exchangers 15.

At this time, the opening degree of the first heat medium flow path switching devices 22 and the second heat medium flow path switching devices 23 is set to an intermediate opening degree so as to secure a flow path flowing to both of the intermediate heat exchanger 15*a* and the intermediate heat exchanger 15*b*. Also, originally, the use-side heat exchanger 26*a* should be controlled by the difference between the temperatures at the entrance and exit thereof. However, the temperature of the heat medium on the entrance sides of the use-side heat exchangers 26 is substantially the same as the temperature detected by the first temperature sensor 31*b*. Accordingly, the number of temperature sensors can be reduced by employing the first temperature sensor 31*b*, and the system can be built at low cost.

When the heating only operation mode is executed, there is no need for the heat medium to flow into the use-side heat exchangers 26 (including thermo-off) having no heat load, and accordingly, the flow path is closed by the heat medium flow control devices 25 so as to prevent the heat medium from flowing into the use-side heat exchangers 26. In FIG. 4, the use-side heat exchanger 26*a* and the use-side heat exchanger 26*b* have heat load, and accordingly, the heat medium flows thereinto. However, the use-side heat exchanger 26*c* and the use-side heat exchanger 26*d* have no heat load, and the corresponding heat medium flow control device 25*c* and the heat medium flow control device 25*d* are fully closed. In the case where heat load has been generated from the use-side heat exchanger 26*c* or the use-side heat exchanger 26*d*, the heat medium flow control device 25*c* or the heat medium flow control device 25*d* is opened to allow the heat medium to circulate.

[Cooling Main Operation Mode]

Figure 5:
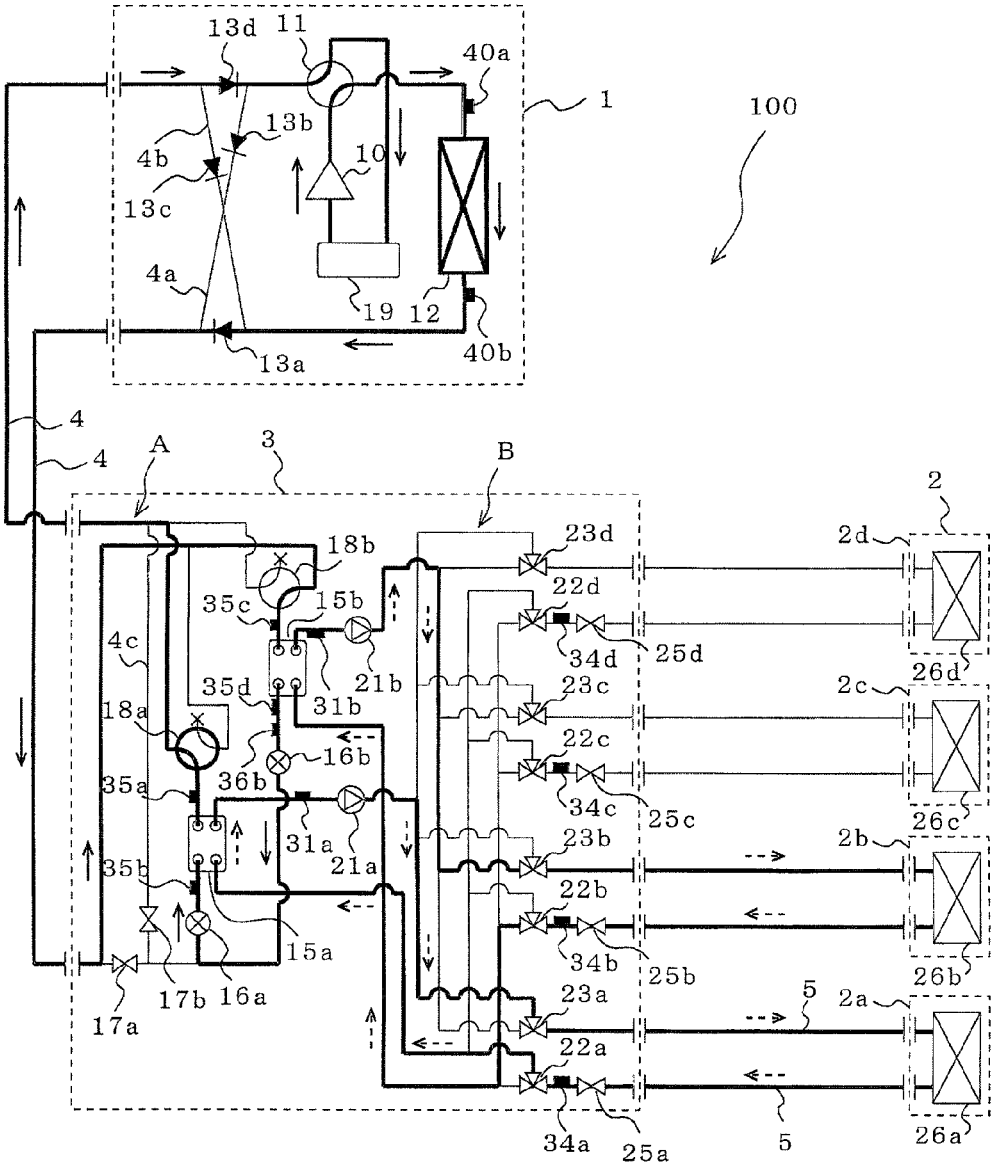
FIG. 5 is a refrigerant circuit diagram illustrating a flow of a refrigerant during a cooling main operation mode of the air-conditioning apparatus illustrated in FIG. 2.

FIG. 5 is a refrigerant circuit diagram illustrating the flow of a refrigerant during the cooling main operation mode of the air-conditioning apparatus 100. In FIG. 5, the cooling main operation mode will be exemplarily described with a case where cooling load is generated in the use-side heat exchanger 26*a* and heating load is generated in the use-side heat exchanger 26*b*. Note that in FIG. 5, a pipe represented with a thick line indicates a pipe through which a refrigerant (heat-source-side refrigerant and heat medium) circulates. Also, in FIG. 5, a solid-line arrow indicates a flow direction of a heat-source-side refrigerant, and a dashed-line arrow indicates a flow direction of a heat medium.

In the case of the cooling main operation mode illustrated in FIG. 5, the first refrigerant flow path switching device 11 of the outdoor unit 1 is switched so that the heat-source-side refrigerant discharged from the compressor 10 flows into the heat-source-side heat exchanger 12. In the heat medium relay unit 3, the pump 21*a* and the pump 21*b* are driven to open the heat medium flow control device 25*a* and the heat medium flow control device 25*b* and to fully close the heat medium flow control device 25*c* and the heat medium flow control device 25*d*, thereby allowing a heat medium to circulate between the intermediate heat exchanger 15*a* and the use-side heat exchanger 26*a*, and between the intermediate heat exchanger 15*b* and the use-side heat exchanger 26*b*.

First, the flow of a heat-source-side refrigerant in the refrigerant circuit A will be described.

A low-temperature and low-pressure refrigerant is compressed by the compressor 10, and is discharged as a high-temperature and high-pressure gas refrigerant. The high-temperature and high-pressure gas refrigerant discharged from the compressor 10 flows into the heat-source-side heat exchanger 12 via the first refrigerant flow path switching device 11, and becomes a liquid refrigerant while transferring heat to the outdoor air in the heat-source-side heat exchanger 12. The refrigerant that has flowed out from the heat-source-side heat exchanger 12 flows out from the outdoor unit 1, passes through the check valve 13*a* and the refrigerant pipe 4, and flows into the heat medium relay unit 3. The refrigerant that has flowed into the heat medium relay unit 3 passes through the second refrigerant flow path switching device 18*b*, and flows into the intermediate heat exchanger 15*b* which serves as a condenser.

The refrigerant that has flowed into the intermediate heat exchanger 15*b* becomes a refrigerant having a further lower temperature while transferring heat to the heat medium which circulates within the heat medium circulation circuit B. The refrigerant that has flowed out from the intermediate heat exchanger 15*b* is expanded in the expansion device 16*b*, and becomes a low-pressure two-phase refrigerant. This low-pressure two-phase refrigerant flows into the intermediate heat exchanger 15*a* which serves as an evaporator via the expansion device 16*a*. The low-pressure two-phase refrigerant that has flowed into the intermediate heat exchanger 15*a* becomes a low-pressure gas refrigerant while cooling the heat medium by absorbing heat from the heat medium which circulates within the heat medium circulation circuit B. This gas refrigerant flows out from the intermediate heat exchanger 15*a*, flows out from the heat medium relay unit 3 via the second refrigerant flow path switching device 18*a*, passes through the refrigerant pipe 4, and flows into the outdoor unit 1 again. The refrigerant that has flowed into the outdoor unit 1 is sucked into the compressor 10 again via the check valve 13*d*, the first refrigerant flow path switching device 11, and the accumulator 19.

At this time, the second refrigerant flow path switching device 18*a* is made to communicate with the low-pressure pipe, and the second refrigerant flow path switching device 18*b* is made to communicate with the high-pressure side pipe. Also, the opening degree of the expansion device 16*b* is controlled so that the superheat obtained as a difference between the temperature detected by the third temperature sensor 35*a* and the temperature detected by the third temperature sensor 35*b* becomes constant. Also, the expansion device 16*a* is in a fully opened state, and the opening/dosing device 17*b* is in a closed state. Note that the opening degree of the expansion device 16*b* may be controlled so that the subcool obtained as a difference between a value obtained by converting the pressure detected by the pressure sensor 36 in terms of saturation temperature and the temperature detected by the third temperature sensor 35*d* becomes constant. Also, an arrangement may be made wherein the expansion device 16*b* is set to a fully opened state, and the superheat or subcool is controlled by the expansion device 16*a*.

Next, the flow of a heat medium in the heat medium circulation circuit B will be described.

In the cooling main operation mode, heating energy of a heat-source-side refrigerant is transferred to the heat medium in the intermediate heat exchanger 15*b*, and the heated heat medium is made to flow within the pipe 5 by the pump 21*b*. Also, in the cooling main operation mode, cooling energy of a heat-source-side refrigerant is transferred to the heat medium in the intermediate heat exchanger 15*a*, and the cooled heat medium is made to flow within the pipe 5 by the pump 21*a*. The heat medium that has pressurized by the pump 21*a* and the pump 21*b* and that has flowed out from the pump 21*a* and the pump 21*b* flows into the use-side heat exchanger 26*a* and the use-side heat exchanger 26*b* via the second heat medium flow path switching device 23*a* and the second heat medium flow path switching device 23*b*, respectively.

In the use-side heat exchanger 26*b*, the heat medium transfers heat to the indoor air, thereby heating the indoor space 7. Also, in the use-side heat exchanger 26*a*, the heat medium absorbs heat from the indoor air, thereby cooling the indoor space 7. At this time, the flow rate of the heat medium is controlled by action of the heat medium flow control device 25*a* and the heat medium flow control device 25*b* so as to obtain a flow rate necessary for covering air conditioning load necessary for indoors, and the heat medium flows into the use-side heat exchanger 26*a* and the use-side heat exchanger 26*b*. The heat medium which has passed through the use-side heat exchanger 26*b* and has been slightly lowered in temperature passes through the heat medium flow control device 25*b* and the first heat medium flow path switching device 22*b*, flows into the intermediate heat exchanger 15*b*, and is sucked into the pump 21*b* again. The heat medium which has passed through the use-side heat exchanger 26*a* and has been slightly increased in temperature passes through the heat medium flow control device 25*a* and the first heat medium flow path switching device 22*a*, flows into the intermediate heat exchanger 15*a*, and is sucked into the pump 21*a* again.

During this period, the heated heat medium and the cooled heat medium are introduced to the use-side heat exchangers 26 which have heating load and the use-side heat exchangers 26 which have cooling load, respectively, without being mixed by action of the first heat medium flow path switching devices 22 and the second heat medium flow path switching devices 23. Note that, within the pipe 5 of the use-side heat exchangers 26, on both of the heating side and the cooling side, the heat medium flows in a direction from the second heat medium flow path switching devices 23 to the first heat medium flow path switching devices 22 via the heat medium flow control devices 25. Also, air conditioning load necessary for the indoor space 7 can be covered by performing control so as to maintain the difference between the temperature detected by the first temperature sensor 31*b* and the temperature detected by the second temperature sensor 34 as a target value on the heating side, and to maintain the difference between the temperature detected by the second temperature sensor 34 and the temperature detected by the first temperature sensor 31*a* as a target value on the cooling side.

When the cooling main operation mode is executed, there is no need for the heat medium to flow into the use-side heat exchangers 26 (including thermo-off) having no heat load, and accordingly, the flow path is dosed by the heat medium flow control devices 25 so as to prevent the heat medium from flowing into the use-side heat exchangers 26. In FIG. 5, the use-side heat exchanger 26*a* and the use-side heat exchanger 26*b* have heat load, and accordingly, the heat medium flows thereinto. However, the use-side heat exchanger 26*c* and the use-side heat exchanger 26*d* have no heat load, and the corresponding heat medium flow control device 25*c* and the heat medium flow control device 25*d* are fully dosed. In the case where heat load has been generated from the use-side heat exchanger 26*c* or the use-side heat exchanger 26*d*, the heat medium flow control device 25*c* or the heat medium flow control device 25*d* is opened to allow the heat medium to circulate.

[Heating Main Operation Mode]

Figure 6:
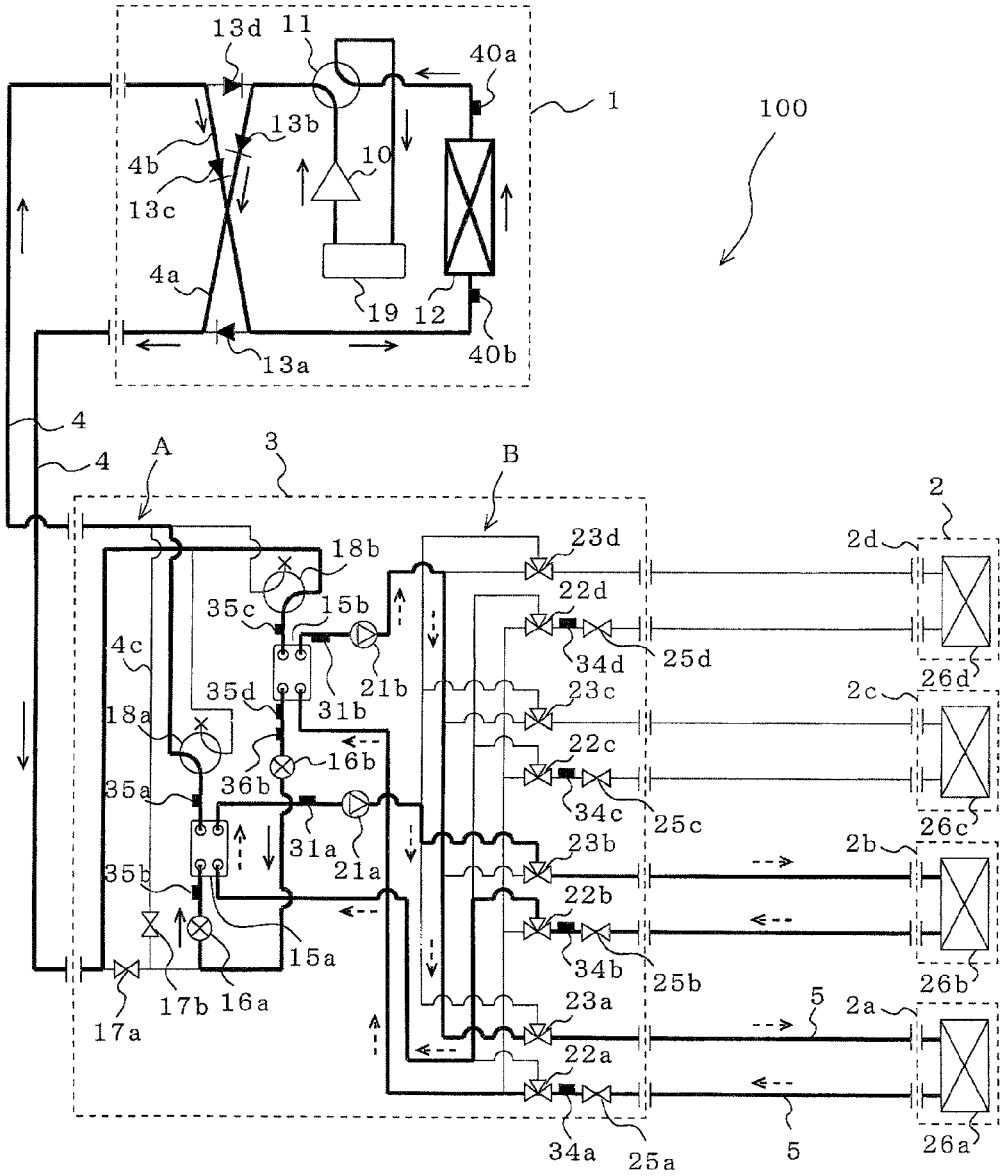
FIG. 6 is a refrigerant circuit diagram illustrating a flow of a refrigerant during a heating main operation mode of the air-conditioning apparatus illustrated in FIG. 2.

FIG. 6 is a refrigerant circuit diagram illustrating the flow of a refrigerant during the heating main operation mode of the air-conditioning apparatus 100. In FIG. 6, the heating main operation mode will be exemplarily described with a case where heating load is generated in the use-side heat exchanger 26*a* and cooling load is generated in the use-side heat exchanger 26*b*. Note that, in FIG. 6, a pipe represented with a thick line indicates a pipe through which a refrigerant (heat-source-side refrigerant and heat medium) circulates. Also, in FIG. 6, a solid-line arrow indicates a flow direction of a heat-source-side refrigerant, and a dashed-line arrow indicates a flow direction of a heat medium.

In the case of the heating main operation mode illustrated in FIG. 6, the first refrigerant flow path switching device 11 of the outdoor unit 1 is switched so that the heat-source-side refrigerant discharged from the compressor 10 flows into the heat medium relay unit 3 without passing through the heat-source-side heat exchanger 12. In the heat medium relay unit 3, the pump 21*a* and the pump 21*b* are driven to open the heat medium flow control device 25*a* and the heat medium flow control device 25*b* and to fully close the heat medium flow control device 25*c* and the heat medium flow control device 25*d*, thereby allowing a heat medium to circulate between the intermediate heat exchanger 15*a* and the use-side heat exchanger 26*b*, and between the intermediate heat exchanger 15*b* and the use-side heat exchanger 26*a*.

First, the flow of a heat-source-side refrigerant in the refrigerant circuit A will be described.

A low-temperature and low-pressure refrigerant is compressed by the compressor 10, and is discharged as a high-temperature and high-pressure gas refrigerant. The high-temperature and high-pressure gas refrigerant discharged from the compressor 10 passes through the first refrigerant flow path switching device 11 and the check valve 13*b*, and flows out from the outdoor unit 1. The high-temperature and high-pressure gas refrigerant that has flowed out from the outdoor unit 1 passes through the refrigerant pipe 4 and flows into the heat medium relay unit 3. The high-temperature and high-pressure gas refrigerant that has flowed into the heat medium relay unit 3 passes through the second refrigerant flow path switching device 18*b*, and flows into the intermediate heat exchanger 15*b* which serves as a condenser.

The gas refrigerant that has flowed into the intermediate heat exchanger 15*b* becomes a liquid refrigerant while transferring heat to the heat medium which circulates within the heat medium circulation circuit B. The refrigerant that has flowed out from the intermediate heat exchanger 15*b* is expanded in the expansion device 16*b*, and becomes a low-pressure two-phase refrigerant. This low-pressure two-phase refrigerant flows into the intermediate heat exchanger 15*a* which serves as an evaporator, via the expansion device 16*a*. The low-pressure two-phase refrigerant that has flowed into the intermediate heat exchanger 15*a* is evaporated by absorbing heat from the heat medium which circulates within the heat medium circulation circuit B, and cools the heat medium. This low-pressure two-phase refrigerant flows out from the intermediate heat exchanger 15*a*, flows out from the heat medium relay unit 3 via the second refrigerant flow path switching device 18*a*, and flows into the outdoor unit 1 again.

The refrigerant that has flowed into the outdoor unit 1 passes through the check valve 13*c*, and flows into the heat-source-side heat exchanger 12 which serves as an evaporator. The refrigerant that has flowed into the heat-source-side heat exchanger 12 then absorbs heat from the outdoor air in the heat-source-side heat exchanger 12, and becomes a low-temperature and low-pressure gas refrigerant. The low-temperature and low-pressure gas refrigerant that has flowed out from the heat-source-side heat exchanger 12 is sucked into the compressor 10 again via the first refrigerant flow path switching device 11 and the accumulator 19.

At this time, the second refrigerant flow path switching device 18*a* is made to communicate with the low-pressure side pipe, and the second refrigerant flow path switching device 18*b* is made to communicate with the high-pressure side pipe. Also, the opening degree of the expansion device 16*b* is controlled so that the subcool obtained as a difference between a value obtained by converting the pressure detected by the pressure sensor 36*b* into saturation temperature and the temperature detected by the third temperature sensor 35*b* becomes constant. Also, the expansion device 16*a* is in a fully opened state, and the opening/closing device 17*a* is in a closed state. Now, an arrangement may be made wherein the expansion device 16*b* is set to a fully opened state, and the subcool is controlled by the expansion device 16*a*.

Next, the flow of a heat medium in the heat medium circulation circuit B will be described.

In the heating main operation mode, heating energy of a heat-source-side refrigerant is transferred to the heat medium in the intermediate heat exchanger 15*b*, and the heated heat medium is made to flow within the pipe 5 by the pump 21*b*. Also, in the heating main operation mode, cooling energy of a heat-source-side refrigerant is transferred to the heat medium in the intermediate heat exchanger 15*a*, and the cooled heat medium is made to flow within the pipe 5 by the pump 21*a*. The heat medium that has pressurized by the pump 21*a* and the pump 21*b* and that has flowed out from the pump 21*a* and the pump 21*b* flows into the use-side heat exchanger 26*a* and the use-side heat exchanger 26*b* via the second heat medium flow path switching device 23*a* and the second heat medium flow path switching device 23*b*, respectively.

In the use-side heat exchanger 26*b*, the heat medium absorbs heat from the indoor air, thereby cooling the indoor space 7. Also, in the use-side heat exchanger 26*a*, the heat medium transfers heat to the indoor air, thereby heating the indoor space 7. At this time, the flow rate of the heat medium is controlled by action of the heat medium flow control device 25*a* and the heat medium flow control device 25*b* so as to obtain a flow rate necessary for covering air conditioning load necessary for indoors, and the heat medium flows into the use-side heat exchanger 26*a* and the use-side heat exchanger 26*b*. The heat medium which has passed through the use-side heat exchanger 26*b* and has been slightly increased in temperature passes through the heat medium flow control device 25*b* and the first heat medium flow path switching device 22*b*, flows into the intermediate heat exchanger 15*a*, and is sucked into the pump 21*a* again. The heat medium which has passed through the use-side heat exchanger 26*a* and has been slightly lowered in temperature passes through the heat medium flow control device 25*a* and the first heat medium flow path switching device 22*a*, flows into the intermediate heat exchanger 15*b*, and is sucked into the pump 21*b* again.

During this period, the heated heat medium and the cooled heat medium are introduced to the use-side heat exchangers 26 which have heating load and the use-side heat exchangers 26 which have cooling load, respectively, without being mixed by action of the first heat medium flow path switching devices 22 and the second heat medium flow path switching devices 23. Note that, within the pipe 5 of the use-side heat exchangers 26, on both of the heating side and the cooling side, the heat medium flows in a direction from the second heat medium flow path switching devices 23 to the first heat medium flow path switching devices 22 via the heat medium flow control devices 25. Also, air conditioning load necessary for the indoor space 7 can be covered by performing control so as to maintain the difference between the temperature detected by the first temperature sensor 31*b* and the temperature detected by the second temperature sensor 34 as a target value on the heating side, and to maintain the difference between the temperature detected by the second temperature sensor 34 and the temperature detected by the first temperature sensor 31*a* as a target value on the cooling side.

When the heating main operation mode is executed, there is no need for the heat medium to flow into the use-side heat exchangers 26 (including thermo-off) having no heat load, and accordingly, the flow path is closed by the heat medium flow control devices 25 so as to prevent the heat medium from flowing into the use-side heat exchangers 26. In FIG. 6, the use-side heat exchanger 26*a* and the use-side heat exchanger 26*b* have heat load, and accordingly, the heat medium flows thereinto. However, the use-side heat exchanger 26*c* and the use-side heat exchanger 26*d* have no heat load, and the corresponding heat medium flow control device 25*c* and the heat medium flow control device 25*d* are fully closed. In the case where heat load has been generated from the use-side heat exchanger 26*c* or the use-side heat exchanger 26*d*, the heat medium flow control device 25*c* or the heat medium flow control device 25*d* is opened to allow the heat medium to circulate.

[Defrost Operation Mode 1]

Figure 7:
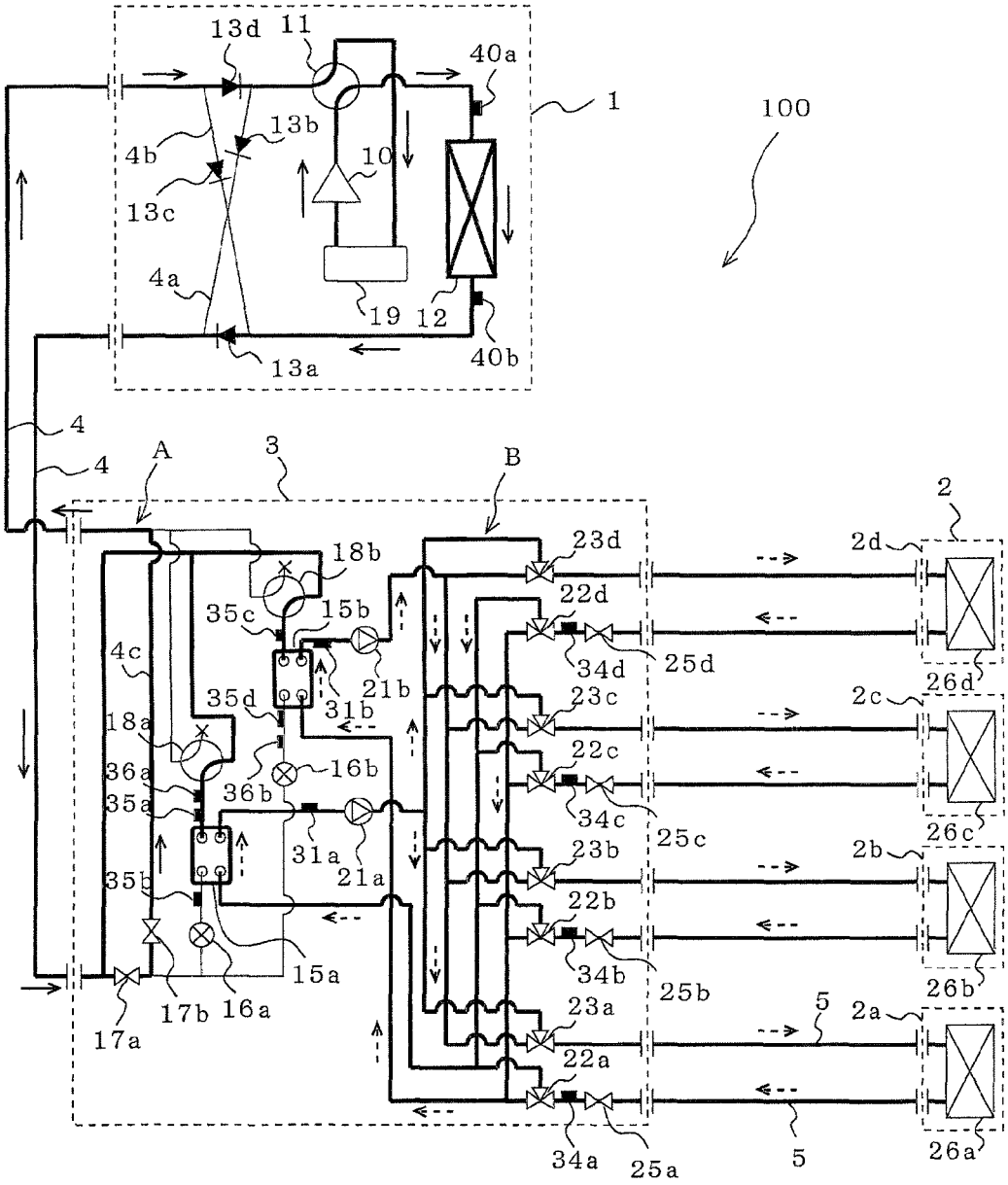
FIG. 7 is a refrigerant circuit diagram illustrating a flow of a refrigerant during a defrost operation mode of the air-conditioning apparatus illustrated in FIG. 2.

FIG. 7 is a refrigerant circuit diagram illustrating the flow of a refrigerant during the defrost operation mode of the air-conditioning apparatus 100 according to Embodiment of the present invention. In FIG. 7, a solid-line arrow indicates a flow direction of a heat-source-side refrigerant, and a dashed-line arrow indicates a flow direction of a heat medium.

A defrost operation mode 1 according to Embodiment is implemented when the detection result of the first outdoor temperature sensor 40*a* is equal to or smaller than a first predetermined value. Specifically, when the air-conditioning apparatus 100 implements a heating only operation or a heating main operation and when the detection result of the first outdoor temperature sensor 40*a* becomes equal to or smaller than a first predetermined value, the controller 70 determines that a predetermined amount of frost formation has occurred on the fins of the heat-source-side heat exchanger 12, and makes the transition to the defrost operation mode 1. Embodiment will be described assuming that all of the four indoor units 2*a* to 2*d* have implemented a heating operation. Note that it is desirable that the first predetermined value is set to a temperature at which frost forms on the heat-source-side heat exchanger 12, for example, approximately −10 degrees Centigrade or lower.

In the defrost operation mode 1 of the air-conditioning apparatus 100 according to Embodiment, in the outdoor unit 1, an air-sending device which is not illustrated is stopped, and the first refrigerant flow path switching device 11 is switched so that the heat-source-side refrigerant discharged from the compressor 10 flows into the heat-source-side heat exchanger 12. Also, in the heat medium relay unit 3, the opening/closing devices 17*a* and 17*b* are opened, the second refrigerant flow path switching devices 18*a* and 18*b* are switched to the heating side, and the expansion devices 16*a* and 16*b* are fully closed.

Also, in the defrost operation mode 1 of the air-conditioning apparatus 100 according to Embodiment, it is assumed that the indoor units 2*a* to 2*d* continue their heating operation. That is to say, the heat medium is transported to the four indoor units 2*a* to 2*d*, and also the operation of a blower fan to be additionally provided in the four indoor units 2*a* to 2*d* is continued. Specifically, in the heat medium relay unit 3, the pumps 21*a* and 21*b* are driven to open the first heat medium flow path switching devices 22*a* to 22*d*, the second heat medium flow path switching devices 23*a* to 23*d*, and the heat medium flow control devices 25*a* to 25*d*, thereby allowing the heat medium to circulate between the intermediate heat exchangers 15*a* and 15*b* and the use-side heat exchangers 26*a* to 26*d*.

Note that in the case where there is no request for a heating operation, or in the case where there is an indoor unit 2 that is in a stopped state, or the like, it is desirable to close the heat medium flow control device 25 corresponding to the indoor unit 2 so as not to transport the heat medium to the use-side heat exchanger 26 corresponding to the indoor unit 2.

Also, in the case where all of the four indoor units 2*a* to 2*d* have no request for a heating operation, or are in a stopped state, it is desirable to stop the unillustrated air-sending devices installed in the indoor units 2, and also to open the four heat medium flow control devices 25*a* to 25*d*, thereby allowing the heat medium to circulate. Thus, the refrigerant in the refrigerant circuit A that has flowed into the intermediate heat exchangers 15 can be prevented from freezing the heat medium in the heat medium circulation circuit B.

First, the flow of a heat-source-side refrigerant in the refrigerant circuit A will be described.

A low-temperature and low-pressure refrigerant is compressed by the compressor 10, and is discharged as a high-temperature and high-pressure gas refrigerant. The high-temperature and high-pressure gas refrigerant discharged from the compressor 10 flows into the heat-source-side heat exchanger 12 via the first refrigerant flow path switching device 11. Then, the high-temperature and high-pressure gas refrigerant becomes a supercooled liquid or a two-phase refrigerant while transferring heat to frost on the fins of the heat-source-side heat exchanger 12. The frost on the fins of the heat-source-side heat exchanger 12 is removed. The high-pressure refrigerant that has flowed out from the heat-source-side heat exchanger 12 flows out from the outdoor unit 1 via the check valve 13*a*, and flows into the heat medium relay unit 3 via the refrigerant pipe 4.

Part of the high-pressure refrigerant that has flowed into the heat medium relay unit 3 is decompressed by passing through the opening/closing device 17*a* and the opening/dosing device 17*b*, and becomes a low-pressure two-phase refrigerant. This low-pressure two-phase refrigerant then flows into the outdoor unit 1 again via the bypass refrigerant pipe 4*c* and the refrigerant pipe 4 without circulating within the refrigerant side flow paths of the intermediate heat exchanger 15*a* and the intermediate heat exchanger 15*b*. Then, the refrigerant that has flowed into the outdoor unit 1 is sucked into the compressor 10 again via the check valve 13*d*, the first refrigerant flow path switching device 11, and the accumulator 19.

On the other hand, the other part of the high-pressure refrigerant that has flowed into the heat medium relay unit 3 flows into the intermediate heat exchangers 15*a* and 15*b* via the second refrigerant flow path switching devices 18*a* and 18*b*.

In the case where the second outdoor temperature sensor 40*b* has detected a temperature equal to or higher than a second predetermined value, the controller 70 ends the defrost operation mode 1, and makes the transition to the heating only operation mode or the heating main operation mode again. Note that it is desirable to set the second predetermined value to a temperature whereby the frost on the heat-source-side heat exchanger 12 can be determined to have been removed, for example, approximately 30 degrees Centigrade or higher.

Also, it has been described that the transition to the heating only operation mode or the heating main operation mode is made after the end of the defrost operation mode 1. In the case where an instruction to execute an operation mode other than these operation modes has been received from the user, for example, the operation mode according to the instruction is executed.

As illustrated in FIG. 7, during the defrost operation mode 1, the second refrigerant flow path switching devices 18*a* and 18*b* are made to communicate with the high-pressure pipe. Thus, the refrigerant that has flowed into the intermediate heat exchangers 15*a* and 15*b* from a side to which the second refrigerant flow path switching devices 18*a* and 18*b* are connected is a supercooled liquid having substantially the same pressure as the heat-source-side refrigerant that is to flow into the heat medium relay unit 3, or a two-phase refrigerant. This refrigerant that has flowed into the intermediate heat exchangers 15*a* and 15*b* is high in pressure and is thus high in saturation temperature, and the saturation temperature thereof is 0 degrees Centigrade or higher. Thus, the intermediate heat exchangers 15*a* and 15*b* are prevented from being cooled to a low temperature of 0 degrees Centigrade or lower. That is to say, the heat medium is prevented from being frozen due to the refrigerant having flowed into the intermediate heat exchangers 15*a* and 15*b*, and accordingly, the operation reliability of the air-conditioning apparatus 100 can be improved.

Now, description will be made regarding a case where there is refrigerant leakage in the expansion devices 16*a* and 16*b*. If a refrigerant flows in a direction from the expansion devices 16*a* and 16*b* to the intermediate heat exchangers 15*a* and 15*b*, the refrigerant will be decompressed by action of the expansion devices 16*a* and 16*b*, and the saturation temperature of the refrigerant may decrease to 0 degrees Centigrade or lower. That is to say, if this decompressed refrigerant flows into the intermediate heat exchangers 15*a* and 15*b*, the intermediate heat exchangers 15*a* and 15*b* are cooled to a low temperature of 0 degrees Centigrade or lower, and the heat medium may be frozen.

In the air-conditioning apparatus 100 according to Embodiment, however, the side of the expansion devices 16*a* and 16*b* connected to the intermediate heat exchangers 15*a* and 15*b* is in high pressure. Thus, even if there is refrigerant leakage in the expansion devices 16*a* and 16*b*, the refrigerant is prevented from flowing in a direction from the expansion devices 16*a* and 16*b* to the intermediate heat exchangers 15*a* and 15*b*. That is to say, even if there is leakage of a refrigerant in the expansion devices 16*a* and 16*b*, the refrigerant is prevented from flowing into the intermediate heat exchangers 15*a* and 15*b* from the expansion devices 16*a* and 16*b* and the heat medium is prevented from freezing.

Next, the flow of a heat medium in the heat medium circulation circuit B will be described.

In the defrost operation mode 1 of the air-conditioning apparatus 100 according to Embodiment, the heat medium is made to flow within the pipe 5 by the pumps 21*a* and 21*b*. That is to say, the heat medium that has been pressurized by the pumps 21*a* and 21*b* and that has flowed out from the pumps 21*a* and 21*b* flows into the use-side heat exchangers 26*a* to 26*d* via the second heat medium flow path switching devices 23*a* to 23*d*. Heat energy generated in the heating only operation mode before the transition to the defrost operation mode 1 has been accumulated in the heat medium that is to flow into the use-side heat exchangers 26*a* to 26*d*. Accordingly, the heating operation can be continued by transporting the heat medium to the use-side heat exchangers 26*a* to 26*d*.

The heat medium that has flowed out from the use-side heat exchangers 26*a* to 26*d* flows into the intermediate heat exchangers 15*a* and 15*b* via the heat medium flow control devices 25*a* to 25*d* and the first heat medium flow path switching devices 22*a* to 22*d*. The heat medium that has flowed out from the intermediate heat exchangers 15*a* and 15*b* is then sucked into the pumps 21*a* and 21*b* again.

Thus, in the air-conditioning apparatus 100 according to Embodiment, the heat medium such as water or an antifreeze is caused to circulate within the heat medium circulation circuit B, so that the heat medium can be prevented from being frozen by the heat-source-side refrigerant flowing into the intermediate heat exchangers 15*a* and 15*b* during the defrost operation mode 1. Thus, the operation reliability of the air-conditioning apparatus 100 can be improved.

Note that, in FIG. 7, description has been made exemplarily regarding a case where the operation mode has been changed from the heating only operation mode to the defrost operation. In the case where the operation mode has been changed to the defrost operation from the heating main operation mode, the flow of the heat medium in the heat medium circulation circuit B is changed to the flow for the heating main operation mode, so that the cooling operation or heating operation of the indoor space 7 can be continued.

[Defrost Operation Mode 2]

Figure 8:
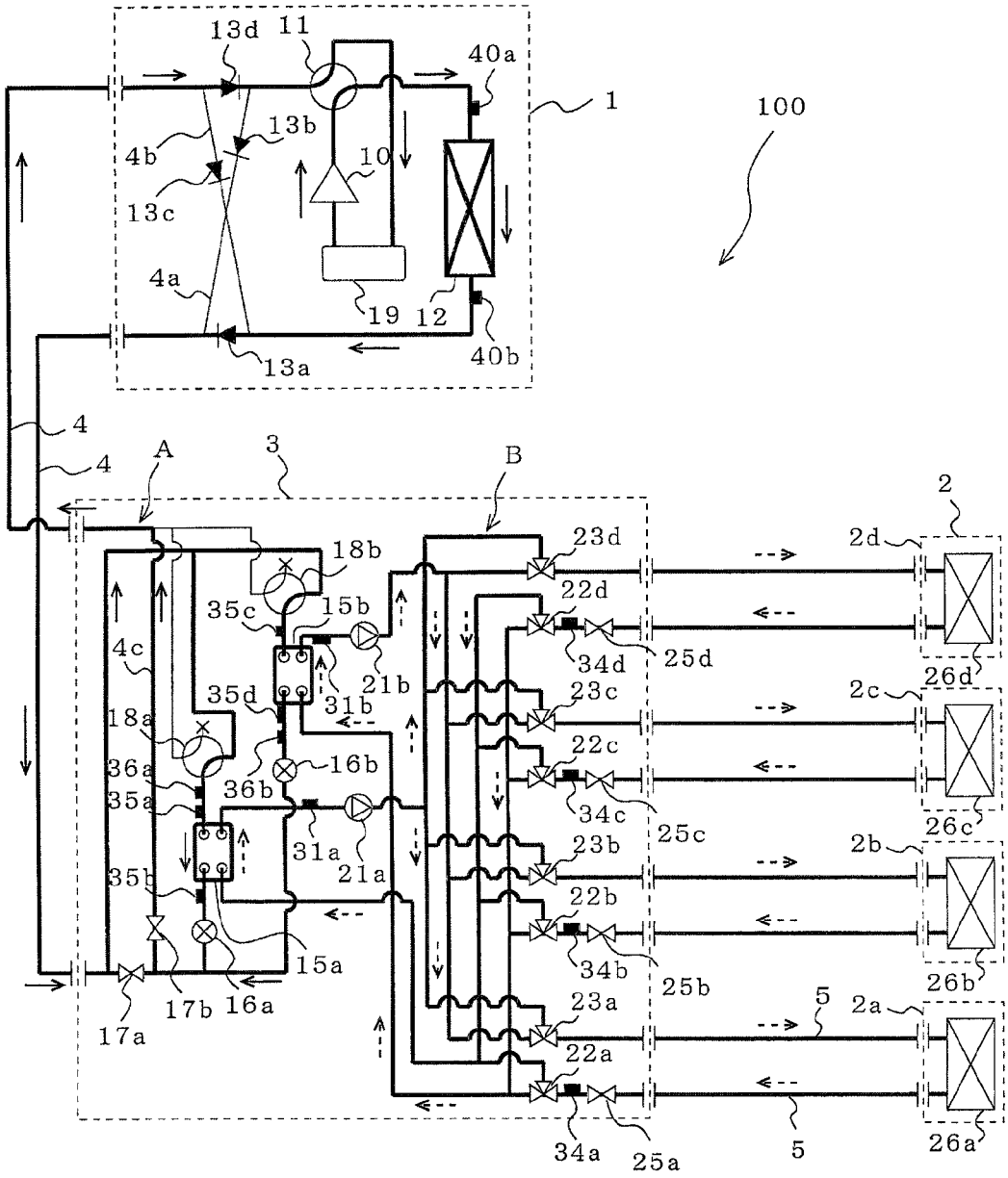
FIG. 8 is a refrigerant circuit diagram illustrating a flow of a refrigerant in a defrost operation mode 2-1 that is one mode of five defrost operation modes 2.
Figure 9:
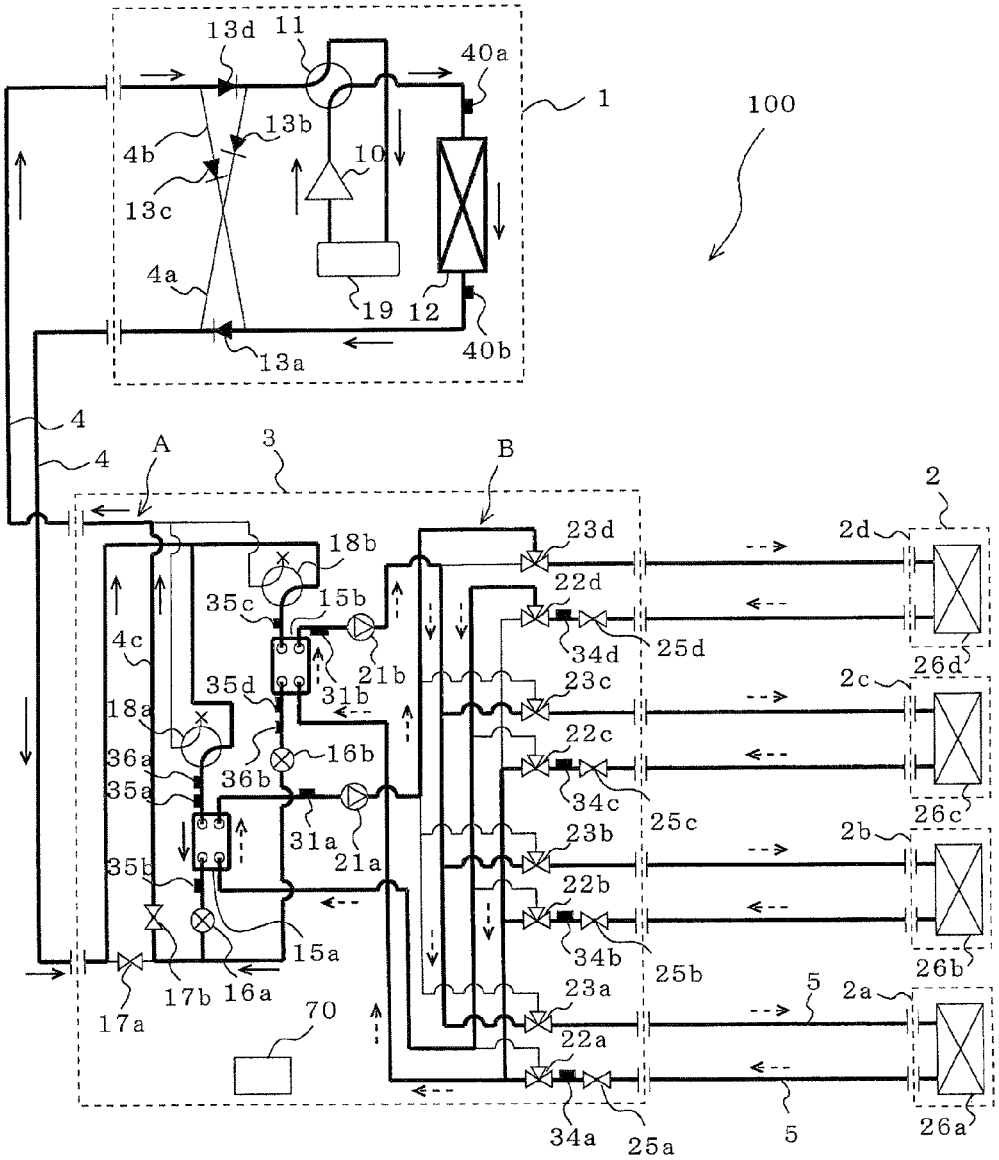
FIG. 9 is a refrigerant circuit diagram illustrating a flow of a refrigerant in a defrost operation mode 2-5 that is one mode of the defrost operation modes 2.

FIG. 8 is a refrigerant circuit diagram illustrating the flow of a refrigerant in a defrost operation mode 2-1 that is one mode of five defrost operation modes 2. FIG. 9 is a refrigerant circuit diagram illustrating the flow of a refrigerant in a defrost operation mode 2-5 that is one mode of the defrost operation modes 2. This air-conditioning apparatus 100 includes five operation modes as the defrost operation modes 2 different from the defrost operation mode 1.

Specifically, the defrost operation modes 2 include a "defrost operation mode 2-1 wherein the opening/dosing device 17*a* is closed, the operation mode is changed from the heating only operation mode, and a refrigerant is circulated in both of the intermediate heat exchangers 15*a* and 15*b*", a "defrost operation mode 2-2 wherein the opening/closing device 17*a* is closed, the operation mode is changed from the heating main operation mode, and a refrigerant is circulated in the intermediate heat exchangers 15*b* alone," a "defrost operation mode 2-3 wherein the opening/closing device 17*a* is opened, the operation mode is changed from the heating only operation mode, and a refrigerant is circulated in both of the intermediate heat exchangers 15*a* and 15*b*," a "defrost operation mode 2-4 wherein the opening/closing device 17*a* is opened, the operation mode is changed from the heating main operation mode, and a refrigerant is circulated in the intermediate heat exchangers 15*b* alone," and a "defrost operation mode 2-5 wherein the operation mode is changed from the heating main operation mode and a refrigerant is circulated in both of the intermediate heat exchangers 15*a* and 15*b*."

The defrost operation modes 2 are also implemented, in a way similar to that in the defrost operation mode 1, when the detection result of the first outdoor temperature sensor 40*a* is equal to or lower than the first predetermined value. Specifically, when the air-conditioning apparatus 100 implements the heating only operation or heating main operation and when the detection result of the first outdoor temperature sensor 40*a* becomes equal to or lower than the first predetermined value, the controller 70 determines that a predetermined amount of frost has been generated on the fins of the heat-source-side heat exchanger 12, and makes the transition to the defrost operation modes 2.

The use of the defrost operation modes 2 is better than the use of the defrost operation mode 1 in order to reduce the defrost time.

(Defrost Operation Mode 2-1)

In the defrost operation mode 2-1 of the air-conditioning apparatus 100 according to Embodiment, in the outdoor unit 1, the air-sending device which is omitted from illustration is stopped, and the first refrigerant flow path switching device 11 is switched so that the heat-source-side refrigerant discharged from the compressor 10 flows into the heat-source-side heat exchanger 12. In the heat medium relay unit 3, the opening/closing device 17*a* is dosed, the opening/closing device 17*b* is opened, the second refrigerant flow path switching device 18 is switched to the heating side, and the expansion devices 16 are opened.

Also, in the defrost operation mode 2-1 of the air-conditioning apparatus 100 according to Embodiment, it is assumed that the indoor units 2*a* to 2*d* continue their heating operation, as in Embodiment. Specifically, in the heat medium relay unit 3, the pumps 21*a* and 21*b* are driven to open the first heat medium flow path switching devices 22*a* to 22*d*, the second heat medium flow path switching devices 23*a* to 23*d*, and the heat medium flow control devices 25*a* to 25*d*, thereby allowing the heat medium to circulate between the intermediate heat exchangers 15*a* and 15*b* and the use-side heat exchangers 26*a* to 26*d*.

Note that in the case where there is no request for a heating operation, or in the case where there is an indoor unit 2 that is in a stopped state, or the like, it is desirable to close the heat medium flow control device 25 corresponding to the indoor unit 2 so as not to transport the heat medium to the use-side heat exchanger 26 corresponding to the indoor unit 2.

Also, in the case where all of the four indoor units 2*a* to 2*d* have no request for a heating operation, or are in a stopped state, it is desirable to stop the unillustrated air-sending devices installed in the indoor units 2, and also to open the four heat medium flow control devices 25*a* to 25*d*, thereby allowing the heat medium to circulate.

First, the flow of a heat-source-side refrigerant in the refrigerant circuit A will be described.

A low-temperature and low-pressure refrigerant is compressed by the compressor 10, and is discharged as a high-temperature and high-pressure gas refrigerant. The high-temperature and high-pressure gas refrigerant discharged from the compressor 10 flows into the heat-source-side heat exchanger 12 via the first refrigerant flow path switching device 11. Then, the high-temperature and high-pressure gas refrigerant becomes a supercooled liquid or a two-phase refrigerant while transferring heat to frost on the fins of the heat-source-side heat exchanger 12. The frost on the fins of the heat-source-side heat exchanger 12 is removed. The high-pressure refrigerant that has flowed out from the heat-source-side heat exchanger 12 passes through the check valve 13*a*, flows out from the outdoor unit 1, passes through the refrigerant pipe 4, and flows into the heat medium relay unit 3.

The supercooled liquid or two-phase refrigerant that has flowed into the heat medium relay unit 3 flows into the intermediate heat exchangers 15*a* and 15*b*. After absorbing heat from the heat medium, the supercooled liquid or two-phase refrigerant is expanded in the expansion devices 16*a* and 16*b* having an opening degree that is fully open or nearly fully open, and becomes a low-pressure two-phase refrigerant. This low-pressure two-phase refrigerant flows into the outdoor unit 1 again via the bypass refrigerant pipe 4*c* and the refrigerant pipe 4. The refrigerant that has flowed into the outdoor unit 1 is sucked into the compressor 10 again via the check valve 13*d*, the first refrigerant flow path switching device 11, and the accumulator 19.

Note that, in the case where the second outdoor temperature sensor 40*b* has detected a temperature equal to or higher than a second predetermined value, the controller 70 ends the defrost operation mode 2-1, and makes the transition to the heating only operation mode or the heating main operation mode again. Note that the second predetermined value is set to approximately 30 degrees Centigrade or higher, for example.

As illustrated in FIG. 8, during the defrost operation mode 2-1, the second refrigerant flow path switching devices 18*a* and 18*b* are made to communicate with the high-pressure pipe. Thus, the refrigerant that has flowed into the intermediate heat exchangers 15*a* and 15*b* from one of the intermediate heat exchangers 15*a* and 15*b* is a supercooled liquid having substantially the same pressure as the heat-source-side refrigerant that is to flow into the heat medium relay unit 3, or a two-phase refrigerant. Note that this supercooled liquid or two-phase refrigerant has a saturation temperature of approximately 0 degrees Centigrade or higher. Also, the heat medium in the heat medium circulation circuit B is heated to approximately 20 degrees Centigrade or higher in the heating only operation mode before the defrost operation mode 2-1.

Accordingly, in the intermediate heat exchangers 15*a* and 15*b*, the refrigerant in the refrigerant circuit A absorbs heat from the heat medium in the heat medium circulation circuit B, and accordingly, the ratio of the gas layer in the low-pressure two-phase refrigerant flowing out from the expansion devices 16*a* and 16*b* increases. That is to say, the ratio of the low-temperature and low-pressure gas refrigerant in the refrigerant to be sucked into the compressor 10 increases. Thus, the heat capacity of a high-temperature and high-pressure gas refrigerant discharged from the compressor 10 increases, and the defrost operation time of the heat-source-side heat exchanger 12 can be reduced.

Note that the temperature of the refrigerant flowing into the intermediate heat exchangers 15*a* and 15*b* becomes approximately 0 degrees Centigrade or higher, and the heat medium is prevented from being cooled to a low temperature of 0 degrees Centigrade or lower. That is to say, the heat medium is prevented from being frozen due to the refrigerant having flowed into the intermediate heat exchangers 15*a* and 15*b*.

Next, the flow of a heat medium in the heat medium circulation circuit B will be described.

Also in the defrost operation mode 2-1 of the air-conditioning apparatus 100 according to Embodiment, the heat medium is made to flow within the pipe 5 by the pumps 21*a* and 21*b*. That is to say, the heat medium that has been pressurized by the pumps 21*a* and 21*b* and that has flowed out from the pumps 21*a* and 21*b* flows into the use-side heat exchangers 26*a* to 26*d* via the second heat medium flow path switching devices 23*a* to 23*d*. Heat energy generated in the heating only operation mode before making the transition to the defrost operation mode 2-1 has been accumulated in the heat medium that is to flow into the use-side heat exchangers 26*a* to 26*d*. Accordingly, the heating operation can be continued by transporting the heat medium to the use-side heat exchangers 26*a* to 26*d*.

The heat medium that has flowed out from the use-side heat exchangers 26*a* to 26*d* flows into the intermediate heat exchangers 15*a* and 15*b* via the heat medium flow control devices 25*a* to 25*d* and the first heat medium flow path switching devices 22*a* to 22*d*. The heat medium that has flowed out from the intermediate heat exchangers 15*a* and 15*b* is sucked into the pumps 21*a* and 21*b* again.

Thus, the heat medium such as water or an antifreeze is caused to circulate within the heat medium circulation circuit B, so that the heat medium can be prevented from being frozen by the heat-source-side refrigerant flowing into the intermediate heat exchangers 15*a* and 15*b* during the defrost operation mode 2-1.

(Defrost Operation Mode 2-2)

Next, description will be made regarding the defrost operation mode 2-2 wherein a defrost operation is implemented from the heating main operation mode illustrated in FIG. 6. Note that description will be made here exemplarily regarding a case where heating has been requested for the indoor unit 2*a*, and cooling has been request for the indoor unit 2*b*.

In the case where the transition to the defrost operation mode 2-2 from the heating main operation mode is made, the expansion device 16*a* is fully closed, or set to an opening degree by which the refrigerant is prevented from flowing, so as to prevent the refrigerant from flowing into the intermediate heat exchanger 15*a* where cooling energy has been generated for cooling. In addition the expansion device 16*b* is opened, thereby allowing the refrigerant to circulate in the intermediate heat exchanger 15*b* in which heating energy has been generated for heating. Also, both of the second refrigerant flow path switching devices 18*a* and 18*b* are switched to the heating side, and are made to communicate with the high-pressure pipe.

The flow of the heat medium in the heat medium circulation circuit B is the flow for the heating main operation mode. Accordingly, during the heating main operation mode before making the transition to the defrost operation mode 2-2, the cooling operation and heating operation for the indoor space 7 can be continued using cooling energy generated in the intermediate heat exchanger 15*a* and heating energy generated in the intermediate heat exchanger 15*b*.

The refrigerant that has flowed into the intermediate heat exchangers 15*a* and 15*b* via the second refrigerant flow path switching devices 18*a* and 18*b* is a supercooled liquid having substantially the same pressure as the heat-source-side refrigerant that is to flow into the heat medium relay unit 3, or a two-phase refrigerant. Note that this supercooled liquid or two-phase refrigerant has a saturation temperature of approximately 0 degrees Centigrade or higher. Also, the heat medium in the heat medium circulation circuit B is heated in the intermediate heat exchanger 15*b* during the heating main operation mode before the defrost operation mode 2-2, and has a temperature of approximately 20 degrees Centigrade or higher. The temperature of the refrigerant flowing into the intermediate heat exchangers 15*a* and 15*b* becomes 0 degrees Centigrade or higher, and the heat medium is prevented from being cooled to a low temperature of approximately 0 degrees Centigrade or lower. That is to say, the heat medium can be prevented from being frozen due to the heat-source-side refrigerant having flowed into the intermediate heat exchanger 15*b*.

(Defrost Operation Mode 2-3)

Description has been made regarding the defrost operation mode 2-1 assuming that the opening/closing device 17*a* is closed, but the defrost operation mode 2-3 wherein the opening/closing device 17*a* is opened may be implemented. That is to say, this defrost operation mode 2-3 is a defrost operation mode to be changed from the heating only operation mode, where the opening/closing device 17*a* is opened. Note that description will be made here exemplarily regarding a case where heating has been requested for the indoor unit 2*a*, and cooling has been request for the indoor unit 2*b*.

In the defrost operation mode 2-3, the opening/closing device 17*a* is opened. Accordingly, the heat-source-side refrigerant flowing out from the expansion device 16*a* via the second refrigerant flow path switching device 18*a* and the intermediate heat exchanger 15*a*, the heat-source-side refrigerant flowing out from the expansion device 16*b* via the second refrigerant flow path switching device 18*b* and the intermediate heat exchanger 15*b*, and the heat-source-side refrigerant flowing in from the opening/closing device 17*a* join together. The resulting refrigerant then flows out from the heat medium relay unit 3 via the opening/closing device 17*b* and the bypass refrigerant pipe 4*c*.

Thus, even when the opening/closing device 17*a* is opened, the refrigerant that has flowed into the heat medium relay unit 3 and that has passed through the opening/closing device 17*a* joins the refrigerant flowing out from the expansion devices 16*a* and 16*b*. Opening the opening/closing device 17*a* reduces the circulation amount of the refrigerant flowing into the second refrigerant flow path switching devices 18 and the intermediate heat exchangers 15 since there is a heat-source-side refrigerant flowing into the bypass refrigerant pipe 4*c* via the opening/closing device 17*a*, and the pressure loss of the heat-source-side refrigerant decreases. The refrigerant pressure within the intermediate heat exchangers 15*a* and 15*b* can be maintained high, in accordance with reduction in the pressure loss of the heat-source-side refrigerant. Thus, the temperature of the intermediate heat exchangers 15*a* and 15*b* can be maintained high, and accordingly, freezing of the heat medium, an antifreeze, or the like can be suppressed.

(Defrost Operation Mode 2-4)

Description has been made regarding the defrost operation mode 2-2 assuming that the opening/closing device 17*a* is closed, but the defrost operation mode 2-4 wherein the opening/closing device 17*a* is opened may be implemented. That is to say, this defrost operation mode 2-4 is a defrost operation mode to be changed from the heating main operation mode, where the opening/closing device 17*a* is opened. Note that description will be made here exemplarily regarding a case where heating has been requested for the indoor unit 2*a*, and cooling has been request for the indoor unit 2*b*.

In the case where the transition to the defrost operation mode 2-4 from the heating main operation mode is made, the expansion device 16*a* is fully closed, or set to an opening degree by which the refrigerant is prevented from flowing, so as to prevent the refrigerant from flowing into the intermediate heat exchanger 15*a* where cooling energy has been generated for cooling. In addition, the expansion device 16*b* is opened, thereby allowing the refrigerant to circulate in the intermediate heat exchanger 15*b* where heating energy has been generated for heating. Also, both of the second refrigerant flow path switching devices 18*a* and 18*b* are switched to the heating side, and are made to communicate with the high-pressure pipe.

The flow of the heat medium in the heat medium circulation circuit B is the flow for the heating main operation mode. Accordingly, during the heating main operation mode before the transition to the defrost operation mode 2-4, the cooling operation and heating operation of the indoor space 7 can be continued using cooling energy generated in the intermediate heat exchanger 15*a* and heating energy generated in the intermediate heat exchanger 15*b*.

Thus, even when the opening/closing device 17*a* is opened, the refrigerant flowing into the heat medium relay unit 3 and passing through the opening/closing device 17*a* joins the refrigerant flowing out from the expansion device 16*b*. That is to say, in the defrost operation mode 2-4, the heat-source-side refrigerant flowing out from the expansion device 16*a* via the second refrigerant flow path switching device 18*a* and the intermediate heat exchanger 15*a*, and the heat-source-side refrigerant flowing in from the opening/closing device 17*a* join together. The resulting refrigerant then flows out from the heat medium relay unit 3 via the opening/closing device 17*b* and the bypass refrigerant pipe 4*c*.

Opening the opening/dosing device 17*a* reduces the circulation amount of the refrigerant flowing into the second refrigerant flow path switching devices 18 and the intermediate heat exchangers 15 since there is a heat-source-side refrigerant flowing into the bypass refrigerant pipe 4*c* via the opening/dosing device 17*a*, and the pressure loss of the heat-source-side refrigerant decreases. The refrigerant pressure within the intermediate heat exchanger 15*b* can be maintained high, in accordance with reduction in the pressure loss of the heat-source-side refrigerant. Thus, the temperature of the intermediate heat exchanger 15*b* can be maintained high, and accordingly, freezing of the heat medium, an antifreeze, or the like can be suppressed.

(Defrost Operation Mode 2-5)

The defrost operation mode 2-2 and the defrost operation mode 2-4 are operation modes in which a refrigerant is not supplied to the intermediate heat exchanger 15*a*. However, the defrost operation mode 2-5 in which a refrigerant is supplied to the intermediate heat exchanger 15*a* may be implemented (see FIG. 9). This defrost operation mode 2-5 is a defrost operation mode to be changed from the heating main operation mode. In the defrost operation mode 2-5, a refrigerant is supplied also to the intermediate heat exchanger 15*a*. Further, the opening/closing device 17*a* is closed, and the opening/closing device 17*b* is opened. Note that, in FIG. 9, description will be made exemplarily regarding a case where heating has been requested for the indoor units 2*a* to 2*c*, and cooling has been requested for the indoor unit 2*d*.

It is desirable to implement this defrost operation mode 2-5 in order to achieve both of improvement in the cooling capacity of an indoor unit which continues its cooling operation and reduction of the defrost time.

In the defrost operation mode 2-5, both of the expansion devices 16*a* and 16*b* has an opening degree that is fully open or nearly fully open, and a refrigerant is caused to circulate in both of the intermediate heat exchanger 15*a* where cooling energy has been generated for cooling, and the intermediate heat exchanger 15*b* where heating energy has been generated for heating. Also, both of the second refrigerant flow path switching devices 18*a* and 18*b* are switched to the heating side, and are made to communicate with the high-pressure pipe. The flow of the heat medium in the heat medium circulation circuit B is the flow for the heating main operation mode, and accordingly, the cooling operation and heating operation of the indoor space 7 can be continued.

A supercooled liquid or two-phase refrigerant of which the refrigerant temperature is approximately 0 degrees Centigrade is caused to flow through the intermediate heat exchanger 15*a*, so that the heat medium in the intermediate heat exchanger 15*a* which circulates in the indoor unit 2*d* where the cooling operation in the defrost operation mode 2-5 continues is cooled by transferring heat to the refrigerant. Cooling capacity is improved as compared to a case where no refrigerant is caused to flow through the intermediate heat exchanger 15*a*.

Further, due to the refrigerant within the intermediate heat exchanger 15*a* absorbing heat from the heat medium, as compared to a case where no refrigerant is caused to flow through the intermediate heat exchanger 15*a*, the ratio of the gas layer in the low-pressure two-phase refrigerant flowing out from the expansion device 16*a* increases. Also, the ratio of the low-temperature and low-pressure gas refrigerant in the refrigerant to be sucked into the compressor 10 increases, and the heat capacity of the high-temperature and high-pressure gas refrigerant to be discharged from the compressor 10 increases. Thus, the defrost operation time of the heat-source-side heat exchanger 12 can be reduced.

The refrigerant that has flowed into the intermediate heat exchangers 15*a* and 15*b* via the second refrigerant flow path switching devices 18*a* and 18*b* is a supercooled liquid having substantially the same pressure as the heat-source-side refrigerant that is to flow into the heat medium relay unit 3, or a two-phase refrigerant. Note that this supercooled liquid or two-phase refrigerant has a saturation temperature of approximately 0 degrees Centigrade or higher.

Also, of the heat medium in the heat medium circulation circuit B, the heat medium heated in the intermediate heat exchanger 15*b* is heated to approximately 20 degrees Centigrade or higher in the heating main operation mode before the defrost operation mode 2-5. On the other hand, of the heat medium in the heat medium circulation circuit B, the heat medium cooled in the intermediate heat exchanger 15*a* has a temperature of approximately 5 to 10 degrees Centigrade or higher. Thus, the temperature of the refrigerant flowing into the intermediate heat exchangers 15*a* and 15*b* becomes approximately 0 degrees Centigrade or higher, and the heat medium is prevented from being cooled to a low temperature of 0 degrees Centigrade or lower. That is to say, the heat medium is prevented from being frozen due to the refrigerant having flowed into the intermediate heat exchangers 15*a* and 15*b*.

Also, in order to further prevent the heat medium in the intermediate heat exchanger 15*a* from being frozen, the following method may be performed. When the temperature of the heat medium flowing into the intermediate heat exchanger 15*a* drops lower than a predetermined temperature (for example, approximately 3 degrees Centigrade or lower), the expansion device 16*a* is dosed for the refrigerant circuit A and the circulation of the heat medium is continued in the heat medium circulation circuit B.

Also, in the case where there has been no request for a heating operation or cooling operation for the indoor space 7, or in the case where the defrost time is to be reduced, the unillustrated air-sending devices installed in the indoor units 2 may be stopped, and the heat medium flow control devices 25 corresponding to the use-side heat exchangers 26 installed in the indoor units 2 which had been operated before the transition to the defrost operation mode 2-5 was made, or all of the indoor units 2, may be opened, thereby allowing the heat medium to circulate. Thus, the heat medium is caused to circulate in the heat medium circulation circuit B, and accordingly, the heat medium is prevented from discharging heat to the air from the use-side heat exchangers 26, whereby the defrost time can further be reduced.

[Refrigerant Pipe 4]

As described above, the air-conditioning apparatus 100 includes several operation modes. In these operation modes, a heat-source-side refrigerant flows through the refrigerant pipe 4 which connects the outdoor unit 1 and the heat medium relay unit 3.

[Pipe 5]

In the several operation modes that the air-conditioning apparatus 100 executes, a heat medium such as water or an antifreeze flows through the pipe 5 which connects the heat medium relay unit 3 and the indoor units 2.

[Heat-Source-Side Refrigerant]

A refrigerant using HFO1234yf, HFO1234ze, R32, HC, and a mixed refrigerant including R32, and HFO1234yf, or a mixed refrigerant including at least one component of these refrigerants can be employed as a heat-source-side refrigerant.

All of these refrigerants are flammable refrigerants. When a plate type heat exchanger is damaged due to freezing or the like, these refrigerants may flow into the heat medium. However, in the air-conditioning apparatus 100, the intermediate heat exchangers 15*a* and 15*b* are not readily damaged because they are not readily frozen. That is to say, even when a flammable refrigerant is employed, a probability that the refrigerant leaks in the space to be air-conditioned can be reduced.

[Heat Medium]

Examples of the heat medium include brine (antifreeze), water, a mixed liquid of brine and water, a mixed liquid of water and additive having high anti-corrosion effect, and so forth. Accordingly, in the air-conditioning apparatus 100, even if the heat medium leaks in the indoor space 7 via the indoor units 2, the use of the heat medium having high safety contributes to safety.

Also, in the cooling main operation mode and the heating main operation mode, when the states (heating or cooling) of the intermediate heat exchanger 15*b* and the intermediate heat exchanger 15*a* change, water which has been hot water is cooled and becomes cold water, and water which has been cold water is heated and becomes hot water, resulting in waste of energy. Therefore, the air-conditioning apparatus 100 is configured so that the intermediate heat exchanger 15*b* is always set to the heating side and the intermediate heat exchanger 15*a* to the cooling side regardless of the cooling main operation mode or the heating main operation mode.

Further, in the case where both heating load and cooling load are generated in the use-side heat exchangers 26, the first heat medium flow path switching devices 22 and the second heat medium flow path switching devices 23 that correspond to the use-side heat exchangers 26 which are performing the heating operation are switched to a flow path connected to the intermediate heat exchanger 15*b* used for heating. In addition, the first heat medium flow path switching devices 22 and the second heat medium flow path switching devices 23 that correspond to the use-side heat exchangers 26 which are performing the cooling operation are switched to a flow path connected to the intermediate heat exchanger 15*a* used for cooling. Thus, the heating operation and the cooling operation can freely be performed in each of the indoor units 2.

Description has been made so far assuming that the air-conditioning apparatus 100 is capable of the cooling and heating mixed operation, but the present invention is not restricted to this. Similar advantages are achieved with, for example, a configuration in which: one intermediate heat exchanger 15 and one expansion device 16 are provided; multiple use-side heat exchangers 26 and the heat medium flow control devices 25 are connected in parallel to the intermediate heat exchanger 15 and the expansion device 16; and only one of the cooling operation and the heating operation can be performed.

Also, it goes without saying that the same holds even in the case where one use-side heat exchanger 26 and one heat medium flow control device 25 are connected. Furthermore, there is no problem even when multiple devices which perform the same operation are installed as the intermediate heat exchangers 15 and the expansion devices 16, as a matter of course. In addition, the heat medium flow control devices 25 have been described exemplarily regarding a case where the heat medium flow control devices 25 are housed in the heat medium relay unit 3. However, the present invention is not restricted to this, and the heat medium flow control devices 25 may be housed in the indoor units 2, or the heat medium relay unit 3 and the indoor units 2 may separately be configured.

Also, in general, there are many cases where an air-sending device is attached to the heat-source-side heat exchanger 12 and the use-side heat exchangers 26, and condensing or evaporation is promoted by blowing air.

However, the present invention is not restricted to this. For example, devices such as panel heaters using radiation may be employed as the use-side heat exchangers 26, and the heat-source-side heat exchanger 12 may be of a water-cooled type wherein heat is moved by water or an antifreeze. That is to say, any kind of device can be employed as the heat-source-side heat exchanger 12 and the use-side heat exchangers 26 as long as this device has a configuration capable of transferring heat or absorbing heat.

REFERENCE SIGNS LIST

1 outdoor unit, 2 indoor unit, 2*a* to 2*d* indoor unit, 3 heat medium relay unit, 4 refrigerant pipe, 4*a* first connection pipe, 4*b* second connection pipe, 4*c* bypass refrigerant pipe, 5 pipe, 6 outdoor space, 7 indoor space, 8 space, 9 building, 10 compressor, 11 first refrigerant flow path switching device, 12 heat-source-side heat exchanger, 13*a* to 13*d* check valves, 15 intermediate heat exchanger, 15*a*, 15*b* intermediate heat exchanger, 16 expansion device, 16*a*, 16*b* expansion devices, 17 opening/dosing device, 17*a*, 17*b* opening/closing devices, 18*a*, 18*b* second refrigerant flow path switching devices, 19 accumulator, 21*a*, 21*b* pump, 22 first heat member flow path switching device, 22*a* to 22*d* first heat member flow path switching devices, 23 second heat medium flow path switching device, 23*a* to 23*d* second heat medium flow path switching devices, 25 heat member flow control device, 25*a* to 25*d* heat member flow control devices, 26 use-side heat exchanger, 26*a* to 26*d* use-side heat exchangers, 31*a*, 31*b* first temperature sensor, 34 second temperature sensor, 34*a* to 34*d* second temperature sensors, 35 third temperature sensor, 35*a* to 35*d* third temperature sensors, 36 pressure sensor, 36*a*, 36*b* pressure sensors, 40*a* first outdoor temperature sensor, 40*b* second outdoor temperature sensor, 70 control device, 100 air-conditioning apparatus, A refrigerant circuit, B heat medium circulation circuit

The invention claimed is:

1. An air-conditioning apparatus comprising:

an outdoor unit including a compressor, a first refrigerant flow path switching device, and a heat-source-side heat exchanger;

a heat medium relay unit including an intermediate heat exchanger, an expansion device, a second refrigerant flow path switching device, and a pump;

at least one indoor unit including a use-side heat exchanger;

a controller;

a refrigerant pipe that connects the compressor, the first refrigerant flow path switching device, the expansion device, the heat-source-side heat exchanger, the second refrigerant flow path switching device, and the intermediate heat exchanger, thereby making up a refrigeration cycle in which a refrigerant circulates, the refrigerant pipe includes a first refrigerant pipe being a pipe that connects the first refrigerant flow path switching device or the heat-source-side heat exchanger and the expansion device, the first refrigerant pipe being a pipe through which the refrigerant flowing into the heat medium relay unit from the outdoor unit flows, a second refrigerant pipe being a pipe that connects the second refrigerant flow path switching device and the first refrigerant flow path switching device or the heat-source-side heat exchanger, the second refrigerant pipe being a pipe through which the refrigerant flowing into the outdoor unit from the heat medium relay unit flows, and a third refrigerant pipe being a pipe that branches off from a first location of the first refrigerant pipe between the first refrigerant flow path switching device or the heat-source-side heat exchanger and the expansion device, and the third refrigerant pipe connects to the second refrigerant flow path switching device; and a heat medium pipe that connects the intermediate heat exchanger, the pump, and the use-side heat exchanger, thereby making up a heat medium circulation circuit in which a heat medium different from the refrigerant circulates;

a bypass pipe having an end connected to the first refrigerant pipe and another end connected to the second refrigerant pipe, the bypass pipe being configured to bypass the second refrigerant flow path switching device, the intermediate heat exchanger and the expansion device;

a first opening/closing device provided in a portion of the first refrigerant pipe, the portion of the first refrigerant pipe being located between the first location of the first refrigerant pipe and a second location where the first refrigerant pipe and the bypass pipe are connected, the first opening/closing device adjusting the flow of the refrigerant which flows into the intermediate heat exchanger from the first refrigerant pipe; and a second opening/closing device provided in the bypass pipe, that adjusts the flow of the refrigerant which bypasses via the bypass pipe, wherein the first refrigerant flow path switching device, in response to being switched, executes a defrost operation mode in which the refrigeration cycle discharges the refrigerant from the compressor and supplies the refrigerant discharged from the compressor to the heat-source-side heat exchanger, the controller is configured to execute the defrost operation mode during the defrost operation mode the controller is configured such that the expansion device is fully closed, and the first opening/closing device and the second opening/closing device are opened, the refrigeration cycle further supplies a first part of the refrigerant flowing out from the heat-source-side heat exchanger to the intermediate heat exchanger through the third refrigerant pipe, the second refrigerant flow path switching device and the intermediate heat exchanger in this order without passing through the expansion device which is fully closed, and the refrigerant cycle returns a second part of the refrigerant flowing out from the heat-source-side heat exchanger to the outdoor unit without passing through the second refrigerant flow path switching device, the expansion device and the intermediate heat exchanger; and wherein the refrigeration cycle returns the refrigerant flowing out from the heat-source-side heat exchanger to the outdoor unit via the first refrigerant pipe, the first opening/closing device, the bypass pipe, the second opening/closing device, and the second refrigerant pipe.

2. The air-conditioning apparatus of claim 1, wherein during the defrost operation mode, the pump is driven to make the heat medium in the heat medium circulation circuit circulate.

3. The air-conditioning apparatus of claim 1, wherein the second refrigerant flow path switching device is constituted by at least one of a four-way valve, a three-way valve, a two-way valve, and a solenoid valve.

4. The air-conditioning apparatus of claim 1, wherein the heat-source-side refrigerant comprises HFO1234yf, HFO1234ze, R32, HC, a mixed refrigerant of R32 and HFO1234yf, or a mixed refrigerant including at least one of these refrigerants.

5. The air-conditioning apparatus of claim 1, the controller is further configured to determine whether or not to implement a defrost operation based on whether a predetermined amount of frost is formed on the heat-source-side heat exchanger.

6. The air-conditioning apparatus of claim 1, wherein during the defrost operation mode, while the expansion device is fully closed, and the first opening/closing device and the second opening/closing device are opened:

the pump causes the heat medium to circulate between the intermediate heat exchanger and the use-side heat exchanger of the at least one indoor unit, and the at least one indoor unit continues a heating operation thereof.

* * * * *